US009267276B2

(12) United States Patent
Hashimoto et al.

(10) Patent No.: US 9,267,276 B2
(45) Date of Patent: Feb. 23, 2016

(54) WATER DISCHARGE DEVICE

(71) Applicant: TOTO LTD., Fukuoka (JP)

(72) Inventors: Hiroshi Hashimoto, Fukuoka (JP); Minoru Sato, Fukuoka (JP); Shuhei Hayata, Fukuoka (JP); Akihiro Uemura, Fukuoka (JP); Yukihiro Kozono, Fukuoka (JP)

(73) Assignee: TOTO LTD., Fukuoka (JP)

( * ) Notice: Subject to any disclaimer, the term of this patent is extended or adjusted under 35 U.S.C. 154(b) by 12 days.

(21) Appl. No.: 14/476,514

(22) Filed: Sep. 3, 2014

(65) Prior Publication Data

US 2015/0020303 A1 Jan. 22, 2015

Related U.S. Application Data

(63) Continuation of application No. 13/556,972, filed on Jul. 24, 2012, now Pat. No. 8,904,574.

(30) Foreign Application Priority Data

| | | |
|---|---|---|
| Jul. 27, 2011 | (JP) | 2011-164684 |
| Feb. 10, 2012 | (JP) | 2012-027659 |
| Feb. 10, 2012 | (JP) | 2012-027665 |

(51) Int. Cl.

| | |
|---|---|
| ***A47K 3/26*** | (2006.01) |
| ***A61H 35/00*** | (2006.01) |
| ***E03D 9/08*** | (2006.01) |

(52) U.S. Cl.
CPC ..... *E03D 9/08* (2013.01)

(58) Field of Classification Search
CPC ..... E03D 9/08
USPC ..... 4/420.1–420.5, 443–448
See application file for complete search history.

(56) References Cited

U.S. PATENT DOCUMENTS

| | | | | |
|---|---|---|---|---|
| 6,754,912 | B1 * | 6/2004 | Hayashi | E03D 9/08 4/420.2 |
| 2011/0173744 | A1 * | 7/2011 | Fukuzato | E03D 9/08 4/443 |

FOREIGN PATENT DOCUMENTS

| | | |
|---|---|---|
| JP | 56-70338 | 6/1981 |

OTHER PUBLICATIONS

An Office Action issued by the Japanese Patent Office on Oct. 14, 2015, which corresponds to Japanese Patent Application No. 2012-027659 and is related to U.S. Appl. No. 14/476,514; with English language translation.

* cited by examiner

*Primary Examiner* — Tuan N Nguyen
(74) *Attorney, Agent, or Firm* — Studebaker & Brackett PC

(57) ABSTRACT

A water discharge device generates a large air bubble having a cross sectional area larger than a channel sectional area of a jetting port when the inside of a water storage chamber is viewed from the jetting port. The water discharge device intermittently forms the large air bubble to change a flow speed of a jet flow.

11 Claims, 27 Drawing Sheets

WATER DISCHARGE DEVICE

CROSS-REFERENCES TO RELATED APPLICATIONS

The present application relates to and claims priority from Japanese Patent Application No. 2011-164684, filed on Jul. 27, 2011, No. 2012-027659, filed on Feb. 10, 2012, and No. 2012-027665, filed on Feb. 10, 2012, the entire disclosure of which are hereby incorporated by reference.

BACKGROUND OF THE INVENTION

1. Field of the Invention

The present invention relates to a water discharge device.

2. Description of the Related Art

Improvement of a feeling of cleaning is demanded for a water discharge device for cleaning a human body. The feeling of cleaning is a feeling that depends on a feeling of stimulation caused by water, which is discharged from the water discharge device, hitting the human body and a feeling of massiveness. If the feeling of stimulation and the feeling of massiveness are compared to characteristics of the water, the feeling of stimulation is a physical quantity represented by a flow speed of the water and the feeling of massiveness is a physical quantity represented by an area of the water hitting the human body (also equivalent to a sectional area of the water immediately before hitting the human body). In other words, the feeling of stimulation is the intensity of stimulation of the water felt by a user according to the flow speed of the water. The feeling of stimulation is intensified if the flow speed of the water increases and is weakened if the flow speed of the water decreases. The feeling of massiveness is a volume of the water felt by the user according to the area of the water hitting the human body. The feeling of massiveness is intensified if the area of the water increases and is weakened if the area of water decreases.

On the other hand, improvement of a water saving function is also demanded for the water discharge device. It is necessary to reduce the volume of water discharged from the water discharge device in order to improve the water saving performance. However, the feeling of massiveness is reduced if the volume of the discharged water is simply reduced. It is likely that users dissatisfied with the feeling of cleaning increase.

Therefore, there is proposed a technique for converting continuous linear water discharge into intermittent discharge by a water mass to secure the area of water hitting a human body and not to spoil the feeling of massiveness while consuming a small volume of water. As an example of this technique, a technique described in Japanese Patent Application Laid-Open Publication No. 2001-90151 (Patent Literature 1) is proposed. In the technique described in Patent Literature 1, a first portion where jetting speed is high and a second portion where jetting speed is low are alternately formed in discharged water and the first portion catches up with the second portion before water arrival at the human body to form a large water mass. In the technique described in Patent Literature 1, in order to form such a speed difference, pressure higher than a water supply pressure to the water discharge device is intermittently applied to substantially vary a water discharge pressure. If the water discharge pressure is substantially varied in this way, intermittent flow speed variation occurs in the water discharge. Therefore, the intermittent water discharge by the water mass explained above is realized.

The technique described in Patent Literature 1 is a technique excellent for surely realizing the intermittent water discharge by the water mass. However, a relatively large pump is necessary to apply the pressure higher than the water supply pressure. If the relatively large pump is indispensable, the entire water discharge device becomes expensive, leading to an increase in the size of the device.

As a technique for periodically varying the flow speed of the discharged water without using a pump, a technique described in Japanese Patent No. 4572999 (Patent Literature 2) is proposed. In Patent Literature 2, air bubbles are mixed in discharged water to cause flow speed variation of the discharged water. According to the description of the Patent Literature 2, in a portion where the volume of the air mixed in cleaning water as air bubbles is larger, the speed of the cleaning water is higher. On the other hand, in a portion where the volume of the air mixed in the cleaning water as air bubbles is smaller, the speed of the cleaning water is lower. Consequently, in the discharged water, repetition of the high-speed portion and the low-speed portion occurs.

The technical idea of Patent Literature 2 is an idea for changing the mixed volume of the air in the cleaning water to give flow speed variation to discharged water. However, the examination by the inventors found that it is difficult to give large flow speed variation to discharged water according to the technical idea of Patent Literature 2. Paragraph 0047 of Patent Literature 2 describes that it is desirable to supply fine air bubbles to the cleaning water in order to efficiently mix the air in the cleaning water. However, the inventors found that, even if the fine air bubbles are mixed in the cleaning water and a mixed volume of the air bubbles is changed, it is difficult to give large flow speed variation to discharged water. If the flow speed variation of the discharged water is small in this way, a long time is necessary until a discharged water portion having relatively low speed catches up with a discharged water portion having relatively high speed. Therefore, the water mass sometimes does not sufficiently grow until the discharged water arrives at the target human body.

SUMMARY OF THE INVENTION

The present invention has been devised in view of such a problem and it is an object of the present invention to provide a water discharge device that can give sufficiently large flow speed variation to discharged water without using a large pump and can form a sufficiently large water mass even if a distance from water discharge to water arrival is short.

In order to solve the problem, according to the present invention, there is provided a water discharge device that discharges water to a human body, the water discharge device including: a water supply path for supplying the water; a jetting port for jetting the water, which is supplied from the water supply path, to a downstream side as a jet flow; a discharge channel provided on the downstream side of the jetting port and including a discharge port for discharging the jet flow to the outside; a water storage chamber provided between the jetting port and the discharge channel and including a water passing path section, which is a path through which the jet flow passes from the jetting port to the discharge channel, and a water storing section for forming stored water to be adjacent to the water passing path section; and an air bubble supplying section configured to generate an air bubble, which is formed by changing the air in a bubble form in the water storing section, and supply the air bubble to the water passing path section. The air bubble supplying section generates a large air bubble having a cross sectional area larger than a channel sectional area of the jetting port when the inside of the water storage chamber is viewed from the jetting port. The air bubble supplying section intermittently supplies the large air bubble to the water passing path section to alternately and repeatedly generate a first water passing state in which the jet flow pierces through the large air bubble and a second water passing state in which the jet flow passes through the stored water and varies water passing resistance of the jet flow in the water passing path section.

According to the present invention, since the air bubble supplying section intermittently supplies the large air bubble having the cross sectional area larger than the flow channel sectional area of the jetting port to the water passing path section, it is possible to alternately and repeatedly generate the first water passing state in which the jet flow pierces though the large air bubble and the second water passing state in which the jet flow passes through the water. In the first water passing state, since the jet flow pierces through the large air bubble, a large volume of the air is present around the jet flow, resistance for decelerating the jet flow is small, and the jet flow moves to the discharge port while the speed of the jet flow is kept. On the other hand, in the second water passing state, since the jet flow passes through the water, the water surrounds the jet flow, resistance for decelerating the jet flow is large, and the jet flow moves to the discharge port while the speed of the jet flow decreases. Therefore, the first water passing state and the second water passing state are alternately and repeatedly generated to vary the water passing resistance of the jet flow in the water passing path section. According to the variation of the water passing resistance, it is possible to substantially vary the speed of the jet flow moving to the discharge port and give large flow speed variation to discharged water and, even if a distance from water discharge to water arrival is short, it is possible to form a sufficiently large water mass.

In the water discharge device according to the present invention, the air bubble supplying section preferably supplies the large air bubble to near the jetting port of the water passing path section.

In this preferred form, since the large air bubble is supplied to near the jetting port of the water passing path section, the large air bubble is extended to the discharge port side by the jet flow jetted from the jetting port. Therefore, it is possible to cause the large air bubble to be present in a long range from the jetting port side to the discharge port side by a simple method of supplying the large air bubble to near the jetting port of the water passing path section. As a result, the length of the jet flow piercing through the large air bubble increases. It is possible to surely prevent deceleration of the jet flow in the first water passing state and surely realize the first water passing state. Therefore, it is possible to give large flow speed variation to discharged water.

It is also assumed that the large air bubble supplied to the water passing path section cannot immediately surround the jet flow. According to the examination of the inventors, it was found that the large air bubble more surely surrounds the jet flow when time elapses after the large air bubble is supplied to the water passing path section and drawn into the jet flow until the large air bubble moves a certain degree of distance. In this preferred form, since the large air bubble is supplied to near the jetting port of the water passing path section, it is possible to secure time after the large air bubble is supplied to the water passing path section and more surely form a state in which the jet flow pierces through the large air bubble in the water passing path section.

In the water discharge device according to the present invention, the air bubble supplying section is preferably configured to supply the large air bubble generated earlier to the water passing path section and, after the entire supplied large air bubble is discharged to the discharge port from the water passing path section, supply the large air bubble generated next to the water passing path section.

In the present invention, it is indispensable for forming a sufficiently large water mass to more surely cause variation of water passing resistance. To form a sufficiently large water mass, it is necessary that, in the second water passing state, an air bubble is not arranged in a section from a place extremely close to the jetting port to a place extremely close to the discharge port and the section is filled with the water. Therefore, in the present invention, the large air bubble generated earlier is supplied to near the jetting port of the water passing path section and, after the entire supplied large air bubble is discharged from the water passing path section to the discharge port, the large air bubble generated next is supplied to the water passing path section. Since timing for supplying the large air bubble to the water passing path section is contrived in this way, it is possible to prevent a situation in which, irrespective of the preceding large air bubble remaining in the water passing path section, the following large air bubble is supplied to the water passing path section and an air bubble is present somewhere in the water passing path section. Therefore, it is possible to surely generate flow speed variation of the discharged water by surely generating the first water passing state and the second water passing state alternately. In this way, it is possible to substantially vary the speed of the jet flow moving to the discharge port to give large flow rage variation to discharged water and it is possible to form a sufficiently large water mass even if a distance from water discharge to water arrival is short.

In the water discharge device according to the present invention, the air bubble supplying section preferably forms a sub-water flow, which is a water flow different from the jet flow, in the water storing section and guides, with the sub-water flow, the large air bubble to near the jetting port of the water passing path section.

In the water storage chamber in the present invention, a negative pressure is generated because the jet flow is jetted from the jetting port to the discharge port. Since the negative pressure acts on an air bubble formed in the water storage chamber, the air bubble is likely to receive force for attracting the air bubble to the discharge port side of the water passing path section. Therefore, in this preferred form, the large air bubble is guided to the jetting port of the water passing path section by the sub-water flow formed in the water storing section. Consequently, it is possible to surely prevent the large air bubble from being immediately drawn into the discharge port side of the water passing path section while being affected by the negative pressure generated by the jet flow.

In the water discharge device according to the present invention, the air bubble supplying section preferably includes a water lead-in port for leading the air into the water storing section and a guide surface extended from the air lead-in port side to the jetting port side of the water passing path section and configured to guide the large air bubble, which is led in from the air lead-in port, to near the jetting port.

In this preferred form, since the guide surface configured to guide the large air bubble to near the jetting port of the water passing path section is extended from the air lead-in port side to the water passing path section, the large air bubble is guided by the guide surface. Therefore, it is possible to surely supply the large air bubble to near the jetting port of the water passing path section.

In the water discharge device according to the present invention, the sub-water flow preferably guides the large air bubble to near the jetting port of the water passing path section while pressing the air led in from the air lead-in port against the guide surface.

In this preferred form, since the sub-water flow presses the large air bubble against the guide surface not to separate from the guide surface, it is possible to surely guide the large air bubble along the guide surface and surely supply the large air bubble to near the jetting port.

In the water discharge device according to the present invention, the guide surface is preferably formed by a continuous surface that smoothly connects the vicinity of the air lead-in port and the vicinity of the jetting port.

In this preferred form, since the vicinity of the air lead-in port and the vicinity of the jetting port are connected by the smooth continuous surface, it is possible to move the large air bubble, which is led in from the air lead-in port, to near the jetting port along the guide surface. Therefore, it is possible to surely guide the large air bubble along the guide surface without separating the large air bubble from the guide surface and surely supply the large air bubble to near the jetting port.

In the water discharge device according to the present invention, the sub-water flow is preferably led into the water storing section from a sub-water flow lead-in port formed separately and independently from the jetting port.

In this preferred form, since the sub-water flow is led in from the sub-water flow lead-in port formed separately and independently from the jetting port, compared with the sub-water flow generated by separating the water led in from the jetting port, it is easy to control the flow speed of the sub-water flow to lower speed. Therefore, since the large air bubble is pressed against the guide surface to a degree at which the large air bubble is not broken by the sub-water flow, it is possible to facilitate stable air bubble growth.

In the water discharge device according to the present invention, the sub-water flow is preferably formed to be capable of maintaining a state in which the large air bubble is allowed to communicate with the air lead-in port until the air led in from the air lead-in port changes to the large air bubble and reaches near the jetting port of the water passing path section.

In this preferred form, since the state in which the large air bubble is allowed to communicate with the air lead-in port is maintained, the large air bubble can continue to be in contact with the guide surface while being kept connected to the air lead-in port. Therefore, it is possible to surely guide the large air bubble along the guide surface without separating the large air bubble from the guide surface and surely supply the large air bubble to near the jetting port.

In the water discharge device according to the present invention, the guide surface is preferably provided along a direction in which the air lead-in port is opened.

In this preferred form, since the guide surface is provided along the direction in which the air lead-in port is opened, it is possible to keep a state in which the air led in from the air lead-in port is connected to the air lead-in port. Therefore, the large air bubble can continue to be in contact with the guide surface while being kept connected to the air lead-in port.

In the water discharge device according to the present invention, the air lead-in port is preferably separated from the water passing path section and provided on an upstream side in a moving direction of the jet flow.

In the water discharge device according to the present invention, a swirling flow is formed in the water storing section by the jet flow and the sub-water flow. Since the jet flow is faster than the sub-water flow, a swirling direction of the swirling flow is substantially affected by the jet flow. Since the jet flow is jetted from the jetting port to the discharge port, the swirling direction of the swirling flow also moves along the jet flow and swirls while being adjacent to the jet flow. Since the swirling flow is accelerated by the jet flow moving from the jetting port to the discharge port, the flow speed of the swirling flow is the highest near the discharge port where the acceleration is completed. The flow speed of the swirling flow is the lowest near the jetting port where the swirling flow swirls in the water storing section and the acceleration is started.

In this preferred form, the arrangement of the air lead-in port is contrived in order to make use of characteristics of a speed distribution of the swirling flow. Since the air lead-in port is arranged on the upstream side, which is the jetting port side, in the moving direction of the jet flow, the air can be led into a region where the flow speed of the swirling flow is the lowest and the air can be grown into the large air bubble. Therefore, the state in which the large air bubble is connected to the air lead-in port is more surely maintained. The large air bubble can continue to be in contact with the guide surface while being kept connected to the air lead-in port.

In the water discharge device according to the present invention, the air bubble supplying section preferably supplies the large air bubble to an end on the jetting port side of the water passing path section to cover the jetting port.

In this preferred form, since the large air bubble is supplied to cover the jetting port, it is possible to cover the vicinity of the jetting port with the air. Therefore, in the first water passing state, generation of a swirl around the jetting port is suppressed. It is possible to suppress disorder of the jet flow due to the generation of a swirl. As a result, the movement of the jet flow is stabilized. It is possible to surely realize the first water passing state. Therefore, it is possible to give large flow speed variation to discharged water.

In the water discharge device according to the present invention, an end on the water passing path section side of the guide surface is preferably provided further on an upstream side than the jetting port in a moving direction of the jet flow.

In the present invention, when the large air bubble reaches near the water passing path section, the large air bubble is drawn to near the discharge port of the water passing path section while being affected by the jet flow jetted from the jetting port. Therefore, in this preferred form, the end of the guide surface is provided further on the upstream side than the jetting port to guide the large air bubble further to the upstream side than the jetting port and more surely supply the large air bubble to the end on the jetting port side of the water passing path section.

In the water discharge device according to the present invention, a large air bubble discharge suppressing section configured to suppress the large air bubble moving along the circumference of the jet flow from moving to the discharge port side and extend the large air bubble to the jetting port side of the water passing path section is preferably provided near the water passing path section.

In the present invention, when the large air bubble reaches near the water passing path section, the large air bubble is drawn to near the discharge port of the water passing path section while being affected by the jet flow jetted from the jetting port. Therefore, in this preferred form, the large air bubble is suppressed from moving to the discharge port side and is extended to the jetting port side. Therefore, it is possible to more surely supply the large air bubble to the end on the jetting port side of the water passing path section.

In order to solve the problem, according to the present invention, there is provided a water discharge device that discharges water to a human body, the water discharge device including: a water supply path for supplying the water; a jetting port for jetting the water, which is supplied from the water supply path, to a downstream side as a jet flow; a discharge channel provided on the downstream side of the jetting port and including a discharge port for discharging the jet flow to the outside; a water storage chamber provided between the jetting port and the discharge channel and including a water passing path section, which is a path through which the jet flow passes from the jetting port to the discharge channel, and a water storing section for forming stored water to be adjacent to the water passing path section; and an air supplying section configured to supply the air to the water passing path section. The air supplying section alternately and repeatedly generate a first water passing state in which the jet flow pierces through the air, by supplying the air so as to cover surroundings of the jet flow and a second water passing state in which the jet flow passes through the stored water, by depressing supply of the air, and varies water passing resistance of the jet flow in the water passing path section, by supplying the air and depressing supply of the air.

According to the present invention, the air supplying section generate a first water passing state in which the jet flow pierces through the air, by supplying the air so as to cover surroundings of the jet flow. The air supplying section generate a second water passing state in which the jet flow passes through the stored water, by depressing supply of the air. Since the air supplying section alternately supplies the air and depresses supply of the air, it is possible to alternately and repeatedly generate the first water passing state and the second water passing state.

In the first water passing state, since the jet flow pierces through the large air bubble, a large volume of the air is present around the jet flow, resistance for decelerating the jet flow is small, and the jet flow moves to the discharge port while the speed of the jet flow is kept. On the other hand, in the second water passing state, since the jet flow passes through the water, the water surrounds the jet flow, resistance for decelerating the jet flow is large, and the jet flow moves to the discharge port while the speed of the jet flow decreases. Therefore, the first water passing state and the second water passing state are alternately and repeatedly generated to vary the water passing resistance of the jet flow in the water passing path section. According to the variation of the water passing resistance, it is possible to substantially vary the speed of the jet flow moving to the discharge port and give large flow speed variation to discharged water and, even if a distance from water discharge to water arrival is short, it is possible to form a sufficiently large water mass.

According to the present invention, it is possible to provide a water discharge device that can give sufficiently large flow speed variation to discharged water without using a large pump and can form a sufficiently large water mass even if a distance from water discharge to water arrival is short.

DETAILED DESCRIPTION OF THE PREFERRED EMBODIMENT

Figure 1:
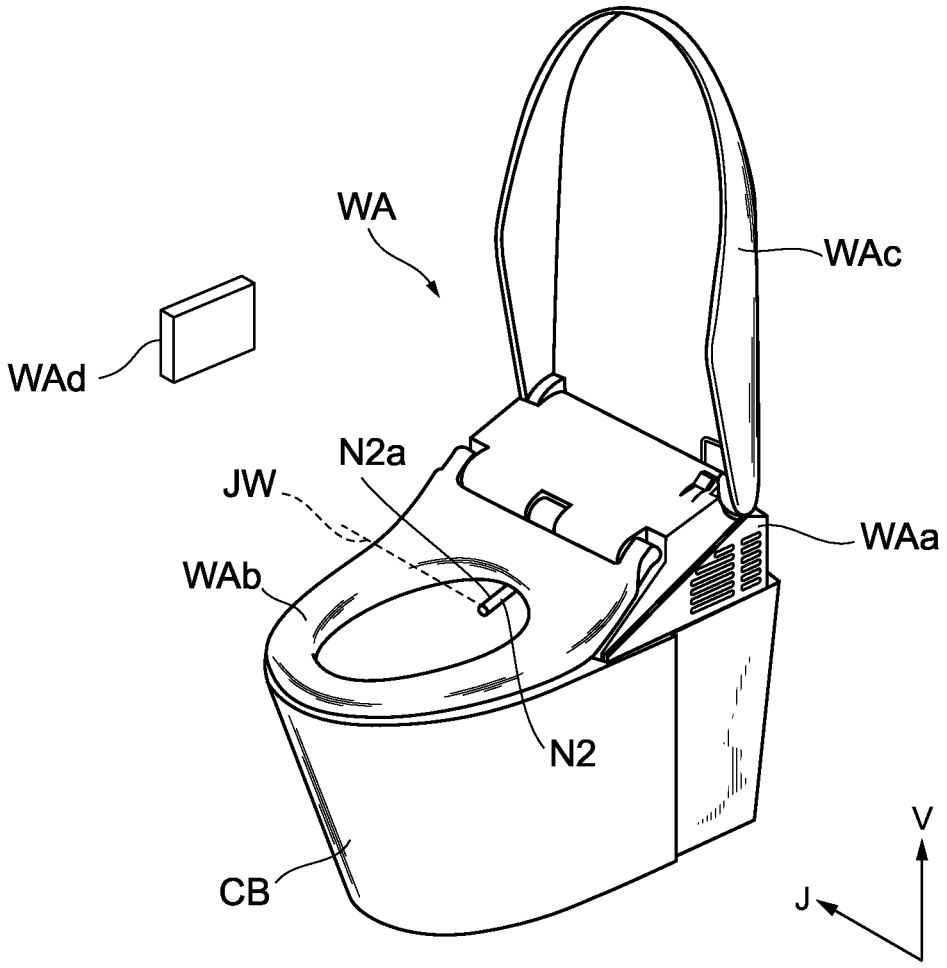
FIG. 1 is a schematic perspective view showing a water discharge device according to an embodiment of the present invention.

An embodiment of the present invention is explained below with reference to the accompanying drawings. To facilitate understanding of the explanation, the same components in the drawings are denoted by the same reference numerals and signs as much as possible and redundant explanation is omitted.

A water discharge device according to the embodiment of the present invention is explained. The water discharge device according to the present invention discharges water to a human body. The water discharge device can give sufficiently large flow speed variation to discharged water without using a large pump and can form a sufficiently large water mass even if a distance from water discharge to water arrival is short. Therefore, an application range of the water discharge device according to the present invention is diversified. The water discharge device can hit the human body with the discharged water formed as a water mass. The water discharge device can be applied to all devices that can realize both of a water saving effect and improvement of a feeling of cleaning. In the explanation of this embodiment, an example in which the water discharge device according to the present invention is applied as a device that performs local cleaning of the human body is explained. In view of the gist of the present invention, the water discharge device according to the present invention is not limited to this.

As shown in FIG. 1, a local cleaning device WA as the water discharge device according to the embodiment of the present invention is used while being placed on a water closet CB. The local cleaning device WA includes a body section WAa, a toilet seat WAb, a toilet lid WAc, and a remote controller WAd. The body section WAa includes a nozzle NZ and holds the nozzle NZ to be capable of moving back and forth. The body section WAa holds the toilet seat WAb and the toilet lid WAc to be capable of pivoting.

In use, a user pivots the toilet lid WAc upward as shown in FIG. 1 and exposes the toilet seat WAb. After sitting on the toilet seat WAb and relieving nature, the user operates the remote controller WAd to discharge water from a discharge port NZa formed in the nozzle NZ and clean the private part of the user. After cleaning the private part, the user operates the remote controller WAd to stop the water discharge from the discharge port NZa. Thereafter, the user operates the remote controller WAd to let cleaning water to flow to the water closet CB.

In this embodiment, as shown in FIG. 1, a J axis along a moving direction of discharged water JW and a V axis along the vertical direction are set. A water discharge form of the local cleaning device WA is explained with reference to the J axis and the V axis.

Figure 2:
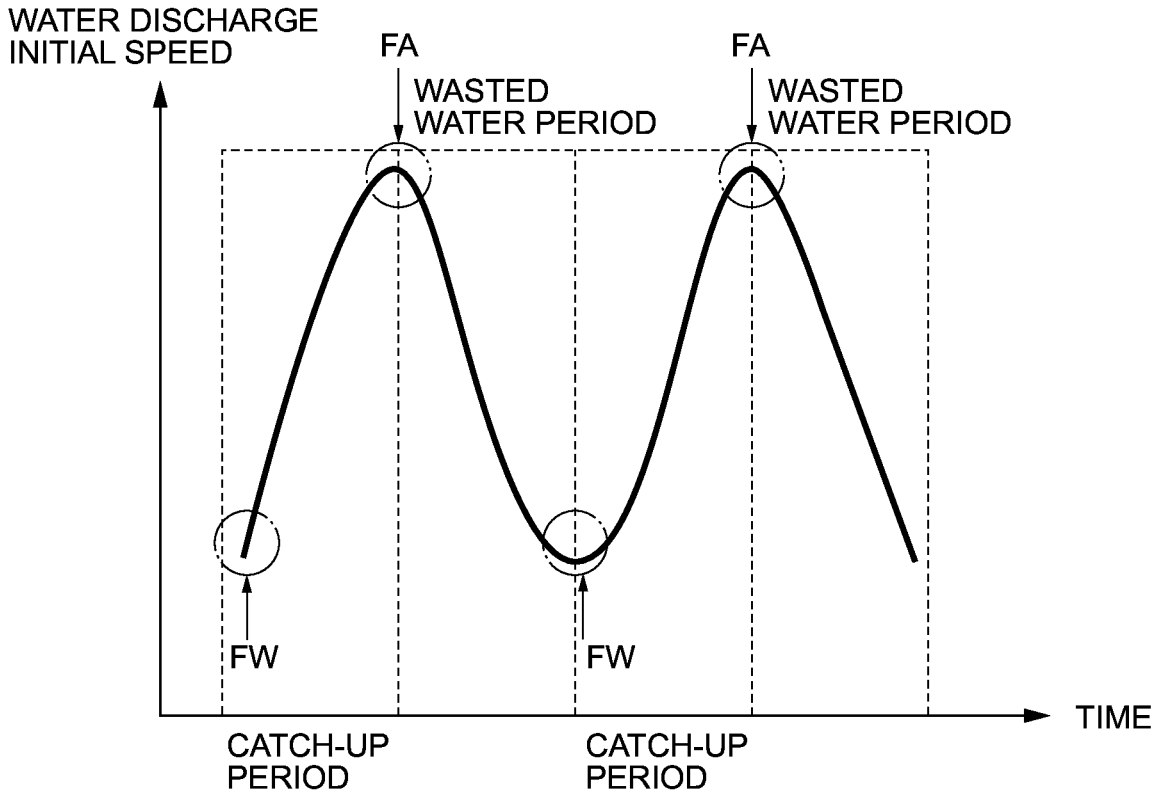
FIG. 2 is a diagram showing variation of water discharge initial speed in the water discharge device shown in FIG. 1.

An example of a form of variation of water discharge initial speed in this embodiment is shown in FIG. 2.

As shown in FIG. 2, the water discharge initial speed is periodically varied to form a catch-up period in which flowing discharged water is caused to catch up with preceding discharged water from a state in which the water discharge initial speed is low (FW in FIG. 2) to a state in which the water discharge initial speed is high (AW in FIG. 2). The periodically formed catch-up period is a period in which the water is discharged without contributing to formation of a water mass. Therefore, in this embodiment, for convenience, the catch-up period is referred to as wasted water period.

Figure 3A:
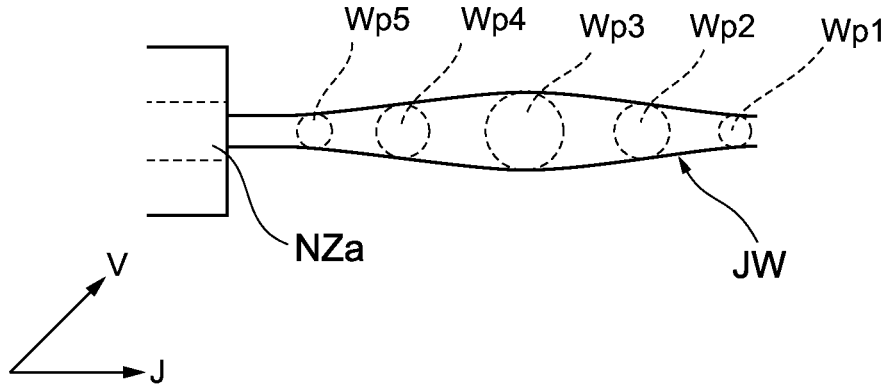
FIGS. 3A to 3C are diagrams schematically showing water discharge states of the water discharge device shown in FIG. 1.
Figure 3B:
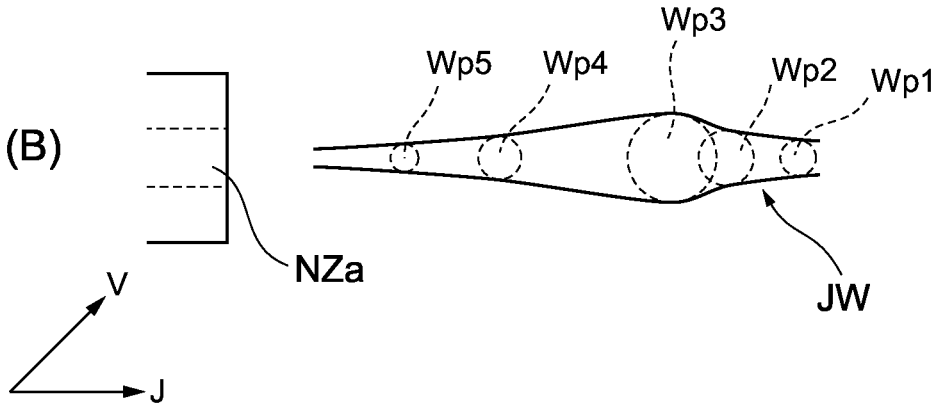
Figure 3C:
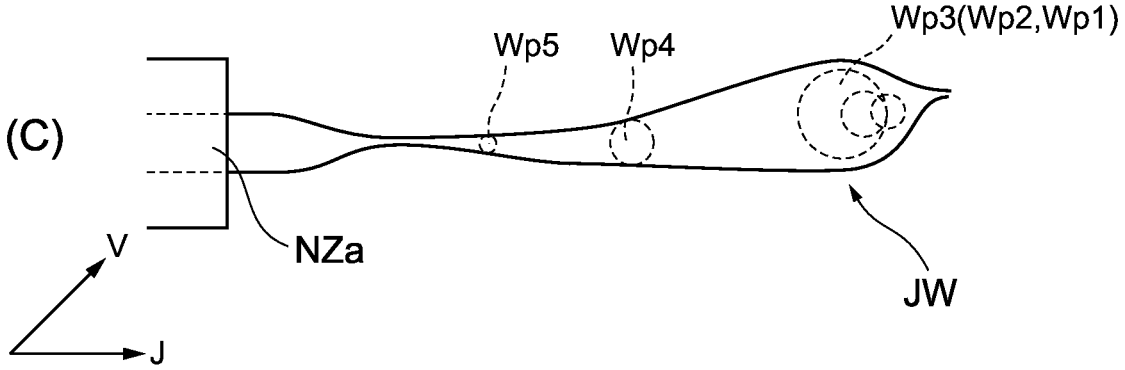

A water discharge state of the local cleaning device WA shown in FIG. 1 is schematically shown in FIGS. 3A to 3C. In this embodiment, the local cleaning device WA is configured to periodically vary the flow speed of discharged water without using a large pump and cause a large water mass to collide against a water discharge target region.

When the variation of the flow speed of the discharged water occurs, as shown in FIG. 3A, the discharged water JW includes a region Wp1, a region Wp2, a region Wp3, a region Wp4, and a region Wp5. When flow speeds of the respective regions are represented as V1, V2, V3, V4, and V5, V1 (≡V5) <V2 (≡V4)<V3.

Therefore, according to a shift from FIG. 3A to FIG. 3C immediately after the water discharge, since the region Wp3 has higher speed than the region Wp2, the region Wp3 combines with the region Wp2 and further combines with the region Wp1 to change to a large water mass.

The region Wp3 having the highest flow speed sequentially combines with the region Wp2 and the region Wp1 preceding the region Wp3 to change to a large mass and arrives at the private part of a human body. When the cleaning water hits the private part of the human body, the cleaning water is in a water mass state in which collision energy (cleaning strength) is large. Since the flow speed V3 of the region Wp3 is the highest, the cleaning water discharge as a pulsating flow is discharged from the discharge port NZa in a water discharge form in which the state of the combined water mass appears in every pulsating period. Moreover, since such a phenomenon occurs in the pulsating period, the water mass undergone the combining of the region Wp3 having the maximum flow speed repeatedly appears. A water mass at certain water discharge timing and a water mass undergone the combining of the region Wp3 at the next water discharge timing are discharged at substantially the same speed. Moreover, the respective water masses are in a state in which the water masses are connected by the region Wp4 and the region Wp5 discharged later than the region Wp3 having the maximum flow speed.

Figure 4:
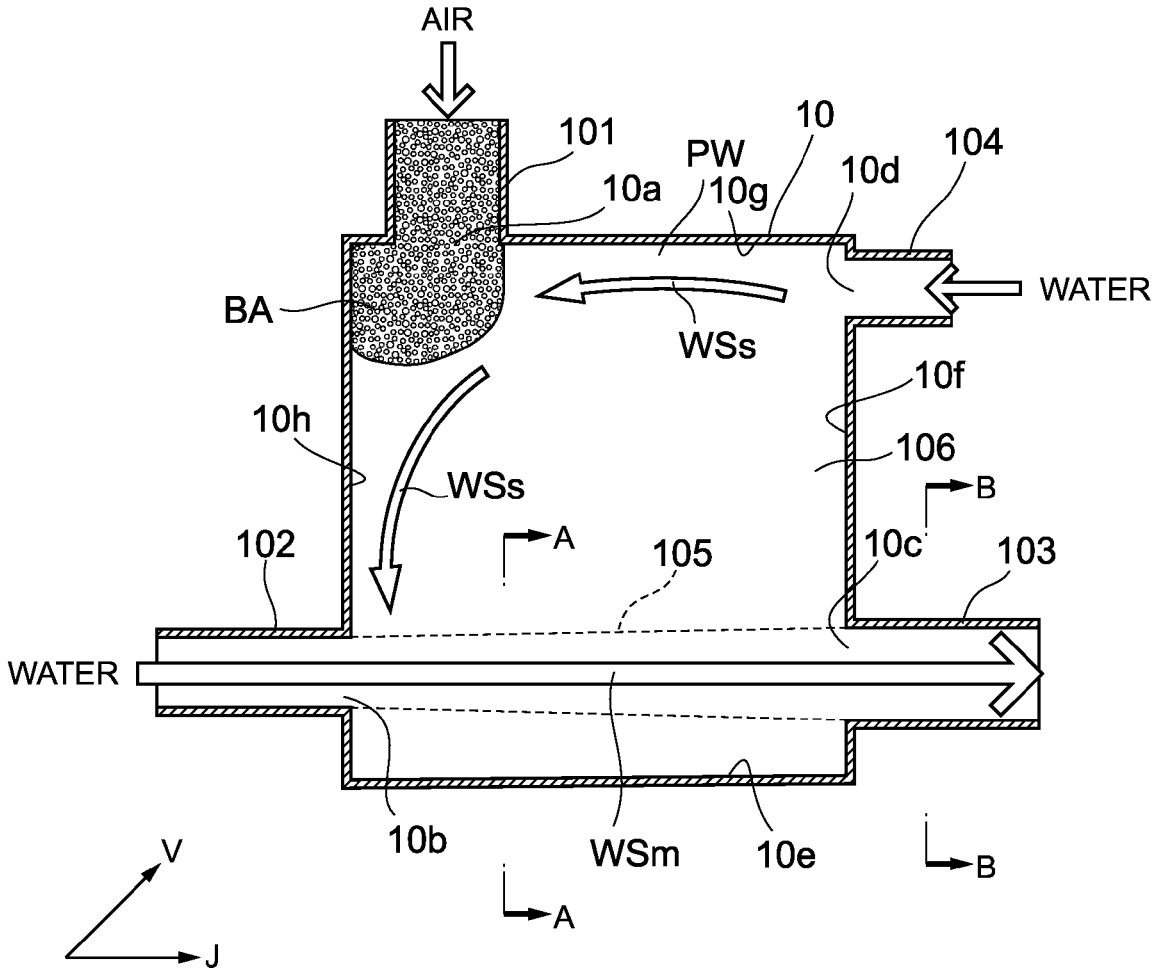
FIG. 4 is a diagram schematically showing a schematic configuration of a water storage chamber included in the water discharge device shown in FIG. 1.

The local cleaning device WA according to this embodiment changes the flow speed of the discharged water without using a large pump and performs water discharge by the water mass that repeatedly and periodically appears described above. The local cleaning device WA includes a water storage chamber 10 on an upstream side of the discharge port NZa of the nozzle NZ shown in FIG. 1. The local cleaning device WA according to this embodiment changes the flow rate of the discharged water by supplying an air bubble with the water storage chamber 10. The configuration of the water storage chamber 10 is explained with reference to FIG. 4. FIG. 4 is a diagram schematically showing a schematic configuration of the water storage chamber 10.

As shown in FIG. 4, the water storage chamber 10 includes an air conduit 101, a first water supply conduit 102 (a water supply path), a discharge conduit 103, and a second water supply conduit 104. The air conduit 101, the first water supply conduit 102, the discharge conduit 103, and the second water supply conduit 104 are conduits provided to communicate with the inside of the water storage chamber 10.

The water storage chamber 10 is formed in a substantially rectangular parallelepiped box shape as a whole. The water storage chamber 10 includes a wall 10*e*, a wall 10*f*, a wall 10*g*, a wall 10*h*, a wall 10*i*, and a wall 10*j*. In FIG. 4, only the wall 10*e*, the wall 10*f*, the wall 10*g*, and the wall 10*h* are drawn to form a rectangle. The wall 10*i* and the wall 10*j* are walls arranged in positions opposed to each other and arranged to connect the wall 10*e*, the wall 10*f*, the wall 10*g*, and the wall 10*h*.

The air conduit 101 communicates with the inside of the water storage chamber 10 via an air lead-in port 10*a* formed in the water storage chamber 10. The air lead-in port 10*a* is formed at an upstream side end of the wall 10*g* near a corner when the wall 10*g* and the wall 10*h* are placed face to face. The first water supply conduit 102 communicates with the inside of the water storage chamber 10 via a jetting port 10*b*. The jetting port 10*b* is formed in the wall 10*h* near a corner where the wall 10*h* and the wall 10*e* are placed face to face. The discharge conduit 103 communicates with the inside of the water storage chamber 10 via a water storage chamber side opening 10*c*. The water storage chamber side opening 10*c* is formed in the wall 10*f* near a corner where the wall 10*f* and the wall 10*e* are placed face to face. The second water supply conduit 104 communicates with the inside of the water storage chamber 10 via a sub-water flow lead-in port 10*d*. The sub-water flow lead-in port 10*d* is formed in the wall 10*f* near a corner where the wall 10*f* and the wall 10*g* are placed face to face.

The air conduit 101 is a conduit that connects the air lead-in port 10*a* and an opening opened to the atmosphere. The air led in from the air conduit 101 is drawn into the inside of the water storage chamber 10 from the air lead-in port 10*a*. The air drawn into the inside of the water storage chamber 10 forms an air bubble BA.

The first water supply conduit 102 is a conduit that connects the jetting port 10*b* and a water supply source. The first water supply conduit 102 is reduced in a diameter halfway in the conduit or in the jetting port 10*b*. Therefore, the water supplied from the first water supply conduit 102 is jetted into the water storage chamber 10 as a jet flow WSm with the speed thereof increased.

The discharge conduit 103 is a conduit that connects the water storage chamber side opening 10*c* and the discharge port NZa formed in the nozzle NZ (see FIG. 1). In the case of this embodiment, the jetting port 10*b* and the water storage chamber side opening 10*c* are arranged to be opposed to each other. Therefore, the jet flow WSm jetted into the water storage chamber 10 from the jetting port 10*b* moves along the J axis in the water storage chamber 10 and enters the discharge conduit 103 from the water storage chamber side opening 10*c*. The water entering the discharge conduit 103 moves in the discharge conduit 103 along the J axis. The water is discharged to the outside form the discharge port NZa.

The second water supply conduit 104 is a conduit that connects the sub-water flow lead-in port 10*d* and the water supply source. The second water supply conduit 104 communicates with the inside of the water storage chamber 10 via the sub-water flow lead-in port 10*d*. At least a part of the water supplied from the second water supply conduit 104 forms a sub-water flow WSs, which is a swirling flow, in the water storage chamber 10.

As explained above, the jet flow WSm jetted into the water storage chamber 10 from the jetting port 10*b* moves along the J axis in the water storage chamber 10 and enters the discharge conduit 103 from the water storage chamber side opening 10*c*. Therefore, a water passing path section 105 is formed which is a path through which the jet flow WSm passes, from the jetting port 10*b* to the discharge port NZa. In the case of this embodiment, the water passing path section 105 is a path that connects the jetting port 10*b* and the water storage chamber side opening 10*c*.

The remaining region excluding the water passing path section 105 in the water storage chamber 10 is a water storing section 106. The water storing section 106 is a section for forming stored water PW to be adjacent to the water passing path section 105. In the case of this embodiment, the water storing section 106 is formed to surround the water passing path section 105.

In the case of this embodiment, the jetting port 10*b* and the water storage chamber side opening 10*c* are arranged near one side of the water storage chamber 10 formed in a rectangular shape. On the other hand, the air lead-in port 10*a* and the sub-water flow lead-in port 10*d* are arranged near the other side of the water storage chamber 10 formed in the rectangular shape. Therefore, the jetting port 10*b* and the water storage chamber side opening 10*c* are arranged to be separated from the air lead-in port 10*a* and the sub-water flow lead-in port 10*d*.

Figure 5:
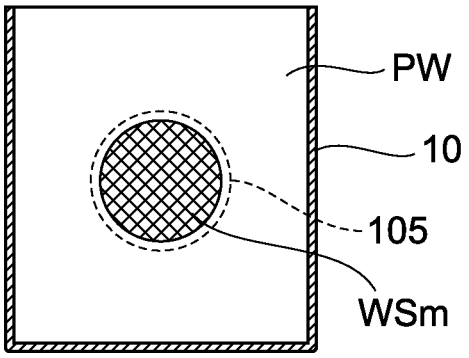
FIG. 5 is a diagram showing an A-A cross section of FIG. 4.
Figure 6:
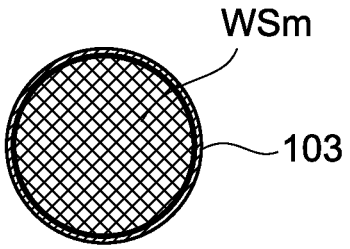
FIG. 6 is a diagram showing a B-B cross section of FIG. 4.

An A-A cross section of FIG. 4 is shown in FIG. 5. A B-B cross section of FIG. 4 is shown in FIG. 6. In the state shown in FIG. 4, the jet flow WSm moves in the stored water PW. As shown in FIG. 5, the jet flow WSm moves to the water storage chamber side opening 10*c* while receiving the resistance from the stored water PW. The jet flow WSm reaching the water storage chamber side opening 10*c* enters the discharge conduit 103. As shown in FIG. 6, the jet flow WSm moves in a state in which the jet flow WSm is in contact with the inner wall surface of the discharge conduit 103.

Figure 7:
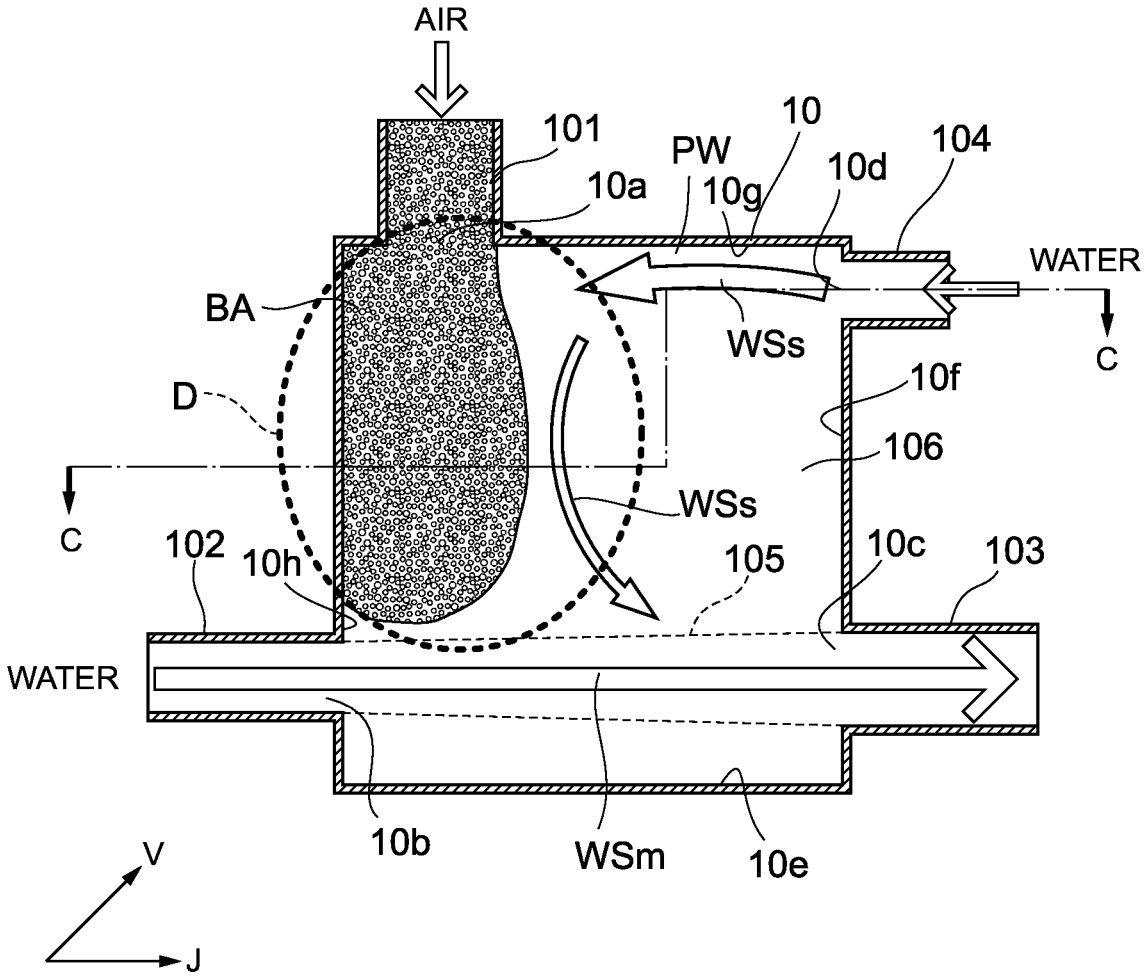
FIG. 7 is a diagram for explaining a form of supplying an air bubble to a jet flow in the water storage chamber shown in FIG. 4.
Figure 8:
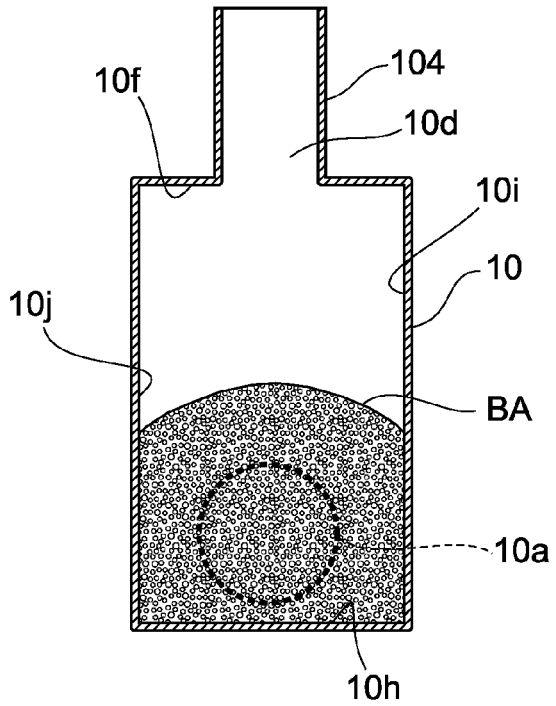
FIG. 8 is a diagram showing a C-C cross section of FIG. 7.

In the state shown in FIG. 4, the air bubble BA is small. When time further elapses from the state shown in FIG. 4, as shown in FIG. 7, the air bubble BA grows into an elongated shape. The air bubble BA grows until the lower end thereof approaches the jet flow WSm. Therefore, a region where the sub-water flow WSs can swirl is narrower than the state shown in FIG. 4. The sub-water flow WSs swirls, at an increased swirling flow speed, in a direction in which the sub-water flow WSs does not hinder the flow of the jet flow WSm. A C-C cross section of FIG. 7 is shown in FIG. 8. A D region of FIG. 7 is shown in FIG. 9.

As shown in FIG. 8, the air bubble BA having the elongated shape grows while being in contact with the three walls 10*h*, 10*i*, and 10*j* among the four walls 10*h*, 10*i*, 10*j*, and 10*f* extending from the air lead-in port 10*a* of the water storage chamber 10 to the jetting port 10*b*. Therefore, a surface in contact with the sub-water flow WSs is only a surface facing the sub-water flow lead-in port 10*d*.

Figure 9:
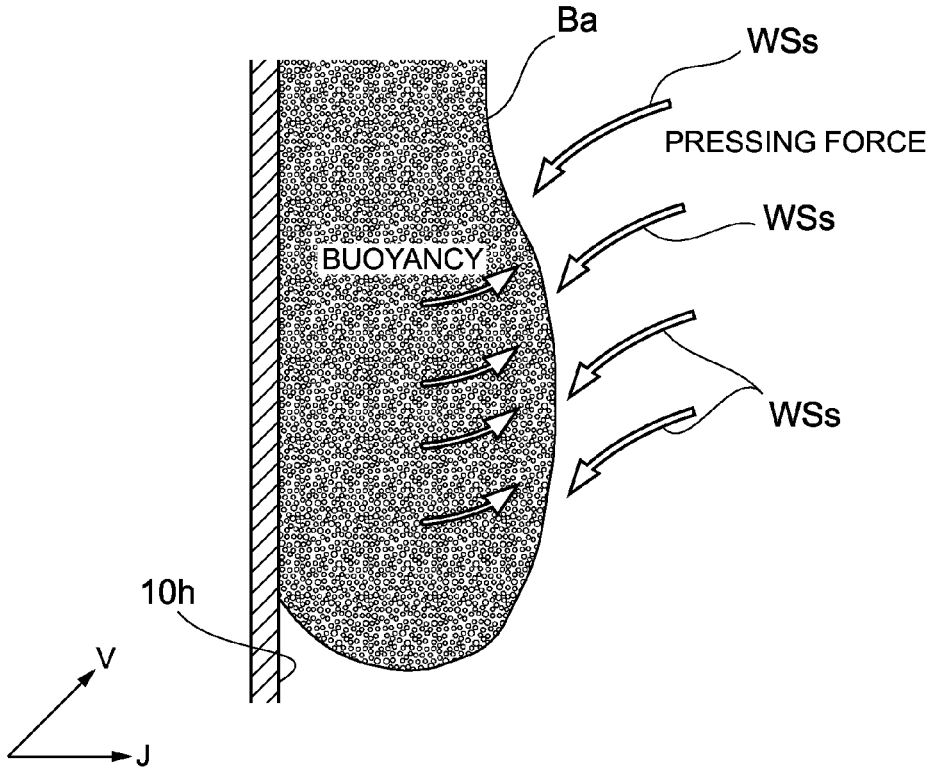
FIG. 9 is an enlarged diagram of a D region shown in FIG. 7.

As shown in FIG. 9, the buoyancy of the air bubble BA grown into the elongated shape acts in a V axis direction, which is the vertical direction. The sub-water flow WSs acts on the air bubble BA to resist the buoyancy. Therefore, the air bubble BA can keep the state in which the air bubble BA is in contact with the three walls 10*h*, 10*i*, and 10*j* among the four walls 10*h*, 10*i*, 10*j*, and 10*f* extending from the air lead-in port 10*a* of the water storage chamber 10 to the jetting port 10*b*.

From a viewpoint of the growth of the air bubble BA having the elongated shape, the walls 10*h*, 10*i*, and 10*j* function as guide surfaces that guide the air bubble BA from the air lead-in port 10*a* to the water passing path section 105. The sub-water flow WSs functions as pressing force applying means for generating force for pressing the air bubble BA toward the walls 10*h*, 10*i*, and 10*j* to prevent the air bubbles BA from separating from the walls 10*h*, 10*i*, and 10*j*, which are the guide surfaces and growing the air bubble into the elongated shape. In this embodiment, the length of the guide surface extending from the air lead-in port 10*a* side to the water passing path section 105 side is preferably set to be larger than the length of the water passing path section 105 extending from the jetting port 10*b* to the water storage chamber side opening 10*c*.

The sub-water flow WSs is a swirling flow and a centrifugal force is generated toward the wall 10*h*. Therefore, the sub-water flow WSs acts to actively press the air bubble BA against the wall 10*h*. However, the air bubble BA expands and changes to a shape close to a spherical shape unless external action does not affect the air bubble BA. Therefore, even if the action for actively pressing the air bubble BA does not affect the air bubble BA, the form of the sub-water flow WSs functioning as the pressing force applying means can be adopted. A modification from such a viewpoint is shown in FIG. 10.

Figure 10:
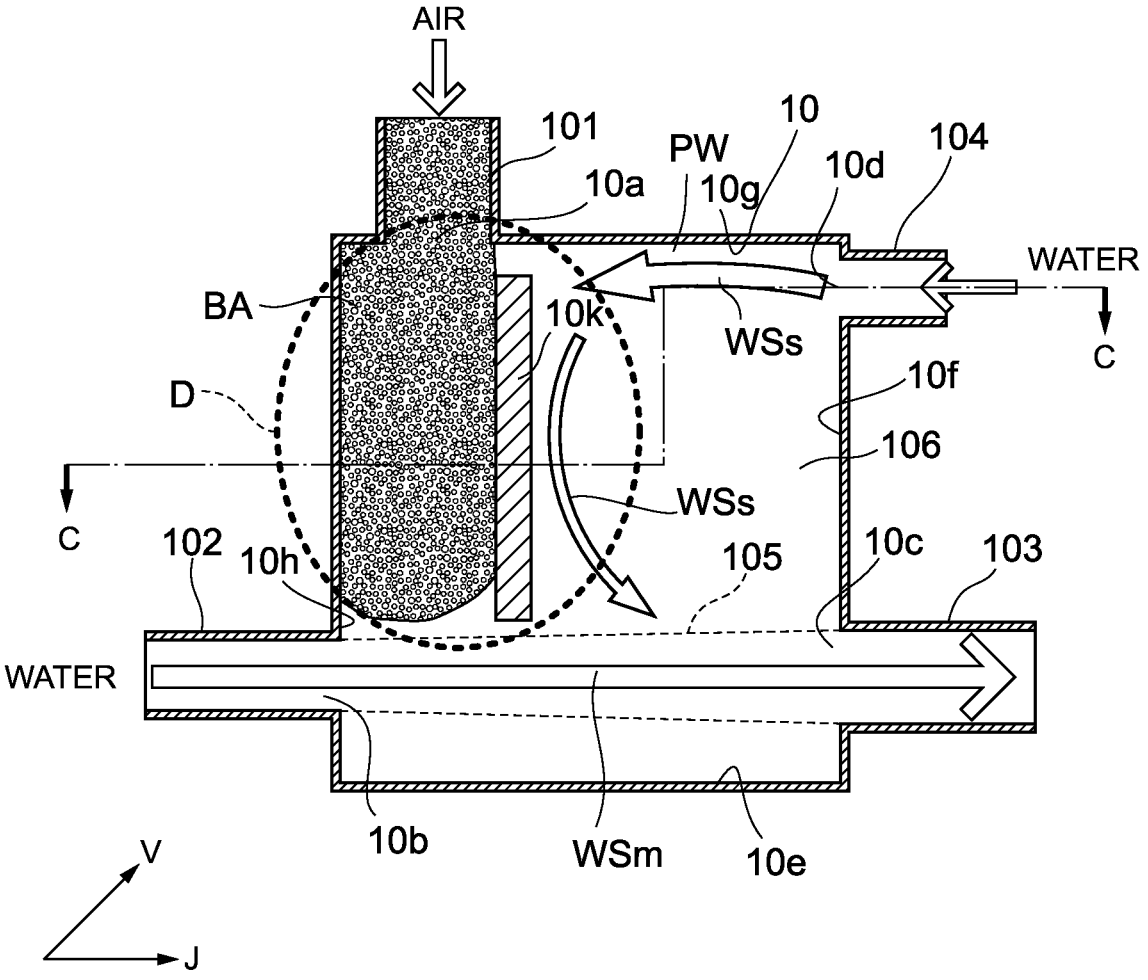
FIG. 10 is a diagram schematically showing a schematic configuration of a water storage chamber included in a water discharge device according to a modification.

As shown in FIG. 10, a wall 10*k* is provided in the water storage chamber 10. The wall 10*k* is provided between the wall 10*h* and the wall 10*f* substantially in parallel to the respective walls. The wall 10*k* is arranged to be separated from the wall 10*g* and the wall 10*e*. The wall 10*k* is provided in a position separated from the water passing path section 105 as well.

Since the wall 10*k* is provided in this way, the air bubble BA led in from the air lead-in port 10*a* moves between the wall 10*h* and the wall 10*k* and grows toward the water passing path section 105. The wall 10*k* does not actively press the air bubble BA toward the wall 10*h*. However, the wall 10*k* suppresses expansion of the air bubble BA to resultantly generate force for pressing the air bubble BA toward the wall 10*h*. The wall 10*k* functions as pressing force applying means.

The wall 10*h* functioning as the guide surface is a linear wall along a plane extending in a direction orthogonal to the wall 10*g* and the wall 10*e*. However, to play the function of the guide surface, the wall 10*h* only has to be a continuous surface that smoothly connects the vicinity of the air lead-in port 10*a* and the vicinity of the jetting port 10*b*. A modification from this viewpoint is explained with reference to FIGS. 11 and 12.

Figure 11:
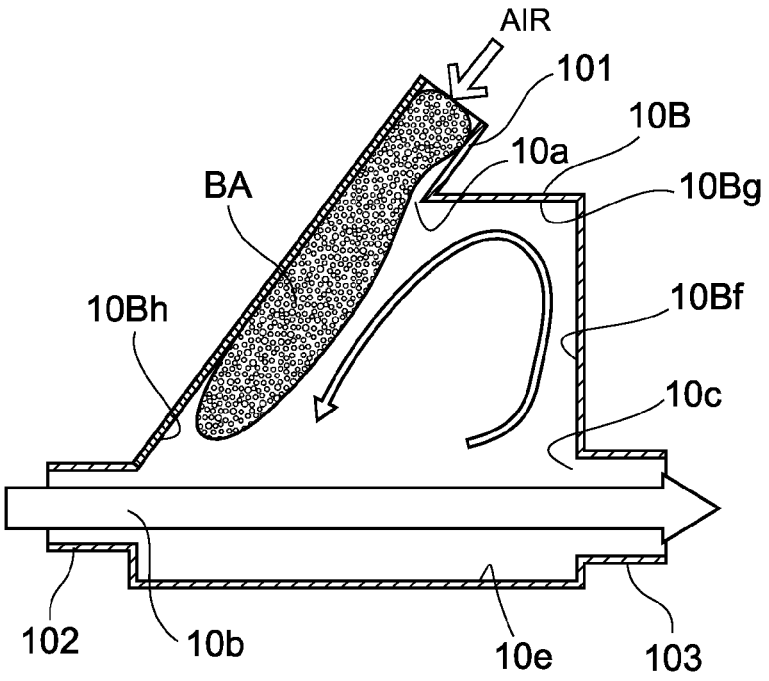
FIG. 11 is a diagram schematically showing a schematic configuration of a water storage chamber included in a water discharge device according to a modification.

A water storage chamber 10B shown in FIG. 11 includes the wall 10*e*, a wall 10Bf, a wall 10Bg, and a wall 10Bh. The air lead-in port 10*a* is provided in the wall 10Bg. The air lead-in port 10*a* is provided in a position opposed to near substantially the center of the wall 10*e*. The wall 10Bh connects the vicinity of the air lead-in port 10*a* and the vicinity of the jetting port 10*b*. Therefore, as shown in FIG. 11, the wall 10Bh is provided to incline. Even if the wall 10Bh is provided to incline in this way, since the wall 10Bh inclines in a direction in which the air lead-in port 10*a* is opened (a direction toward the jetting port 10*b*), the wall 10Bh plays the function of the guide surface for growing the air bubble BA.

Figure 12:
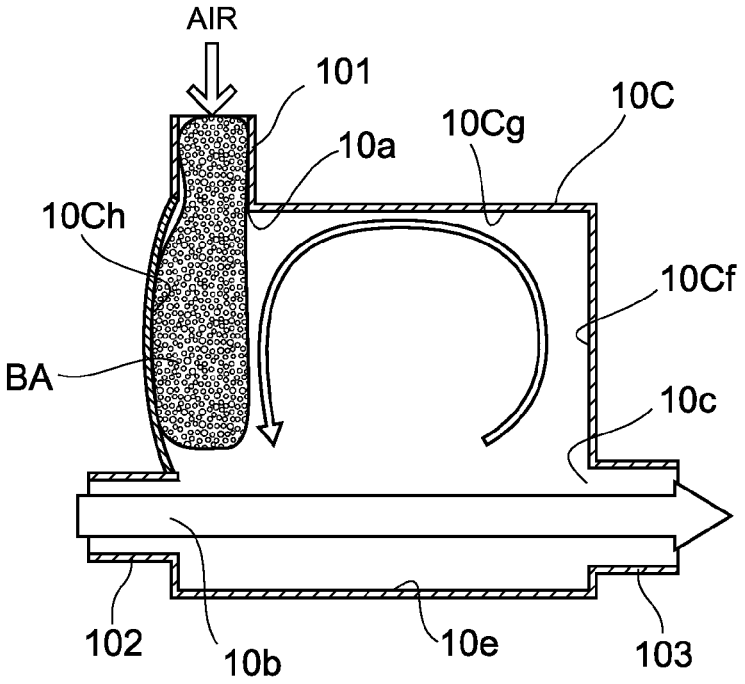
FIG. 12 is a diagram schematically showing a schematic configuration of a water storage chamber included in a water discharge device according to a modification.

A water storage chamber 10C shown in FIG. 12 includes the wall 10*e*, a wall 10Cf, a wall 10Cg, and a wall 10Ch. The wall 10Ch of the water storage chamber 10C is formed in a shape curved toward the outer side. Even if the wall 10Ch is curved in this way, since the wall 10Ch smoothly connects the vicinity of the air lead-in port 10*a* and the vicinity of the jetting port 10*b*, the wall 10Ch plays the function of the guide surface for growing the air bubble BA.

Figure 13:
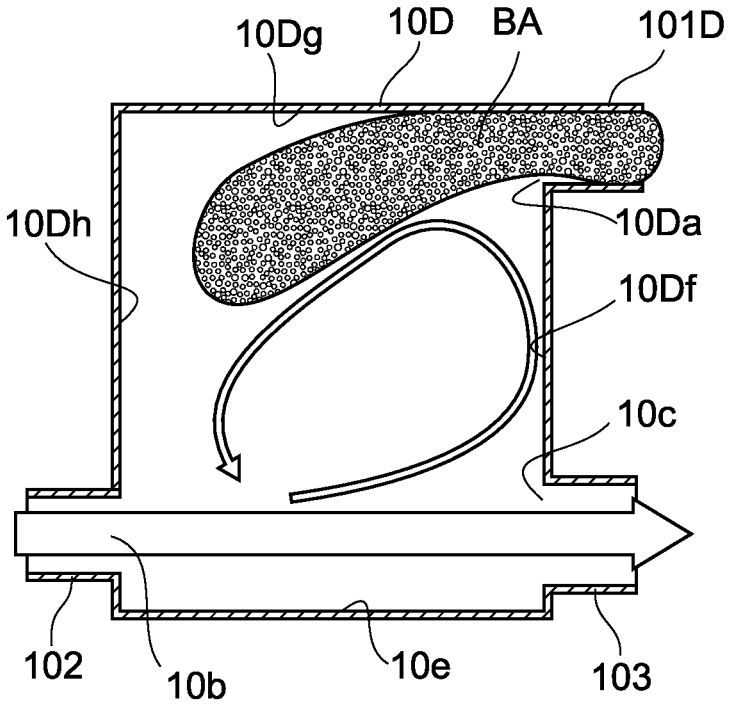
FIG. 13 is a diagram schematically showing a schematic configuration of a water storage chamber included in a water discharge device according to a modification.

A modification in which an arrangement position of an air lead-in port is changed is explained with reference to FIG. 13. A water storage chamber 10D shown in FIG. 13 includes the wall 10*e*, a wall 10Df, a wall 10Dg, and a wall 10Dh. A air lead-in port 10Da is provided in the wall 10Df at a corner where the wall 10Df and the wall 10Dg are placed face to face. As shown in FIG. 13, since the corner where the wall 10Dg and the wall 10Dh are placed face to face is formed, a wall extending from the air lead-in port 10Da to the jetting port 10*b* does not smoothly continue and forms a discontinuous surface. In this case, the wall 10Df does not sufficiently play the function of the guide surface. However, the wall 10Df can form the air bubble BA having the elongated shape.

Figure 14:
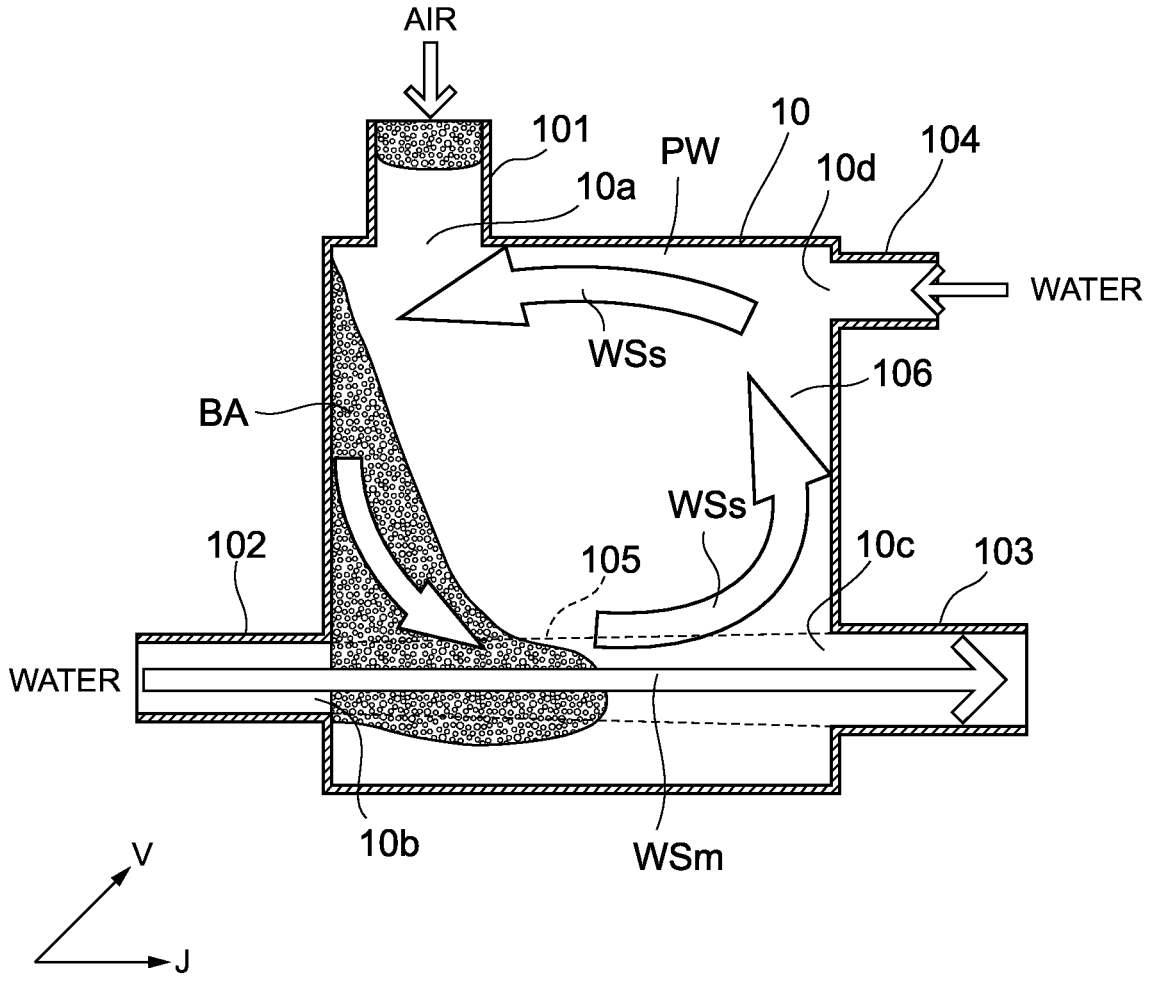
FIG. 14 is a diagram for explaining a form of supplying the air bubble to the jet flow in the water storage chamber shown in FIG. 4.

When time further elapses from the state shown in FIG. 7, as shown in FIG. 14, the air bubble BA having the elongated shape approaches the jet flow WSm and starts to interfere with the jet flow WSm. The air bubble BA is drawn by the jet flow WSm to enter the water passing path section 105. Therefore, the water equivalent to the entered air bubble BA is pushed away. The swirling flow speed of the sub-water flow WSs increases. The sub-water flow WSs with the increased swirling flow speed tears off the air bubble BA.

Figure 15:
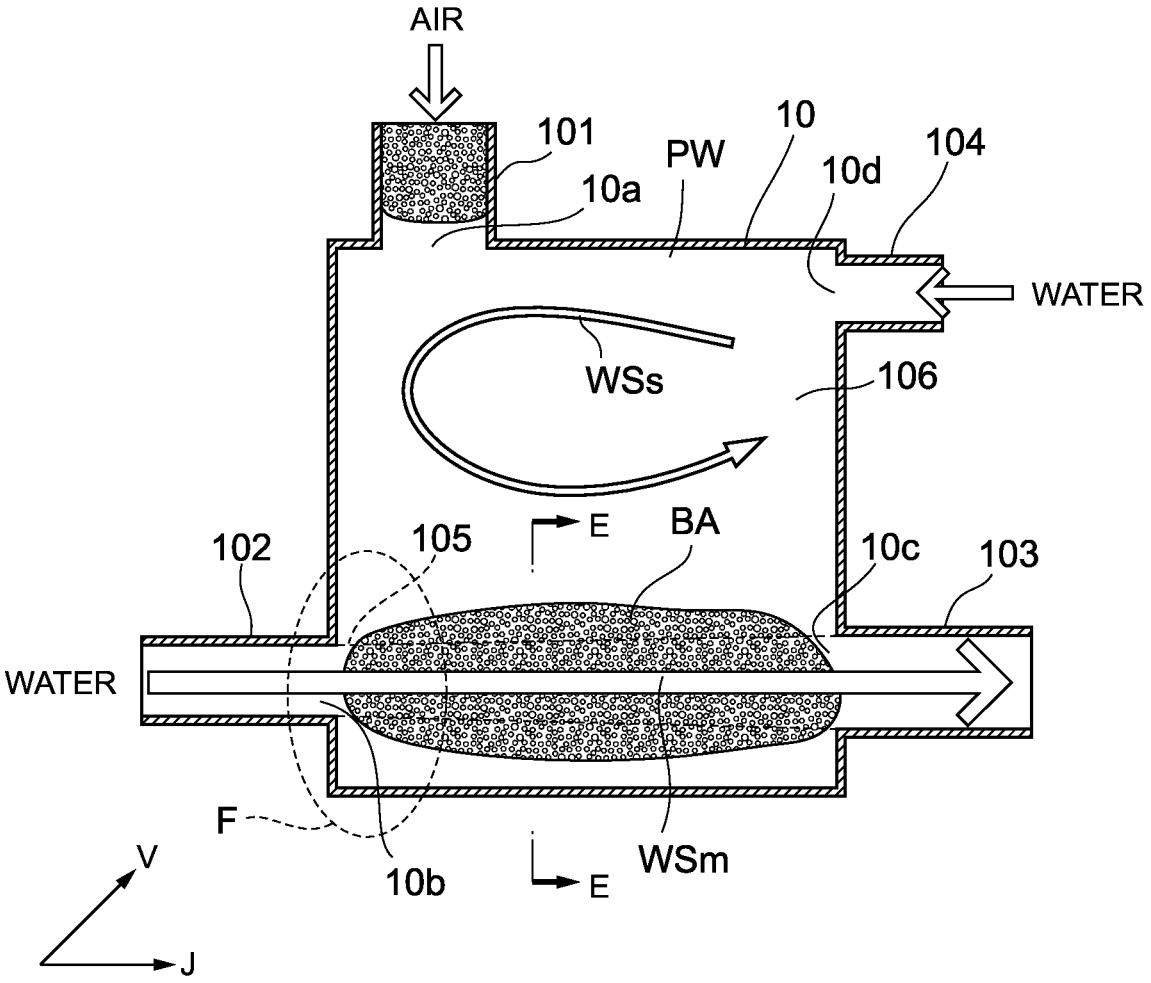
FIG. 15 is a diagram for explaining the form of supplying the air bubble to the jet flow in the water storage chamber shown in FIG. 4.
Figure 16A:
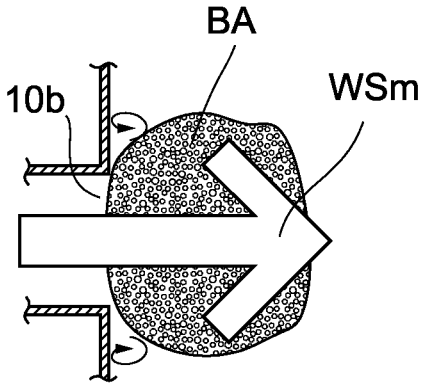
FIGS. 16A and 16B are enlarged diagrams of an F region shown in FIG. 15.
Figure 16B:
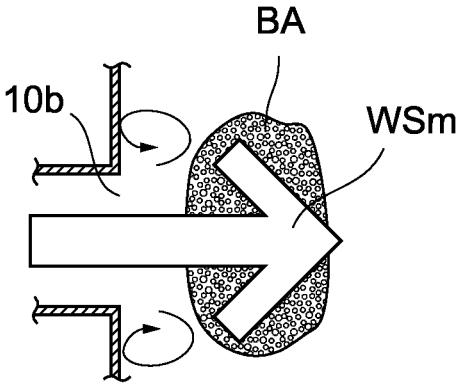

When time further elapses from the state shown in FIG. 14, as shown in FIG. 15, the air bubble BA is completely drawn into the jet flow WSm. The air bubble BA is present over the entire region of the water passing path section 105. An F region of FIG. 15 is shown in FIGS. 16A and 16B. An E-E cross section of FIG. 15 is shown in FIG. 17.

As shown in FIG. 16A, since the air bubble BA is present over the entire region of the water passing path section 105, the air bubble BA is present up to near the jetting port 10*b*. Therefore, a volume of the water present near the jetting port 10*b* decreases and generation of a swirling flow near the jetting port 10*b* is suppressed. When the air bubble BA is formed in a position apart from the jetting port 10*b*, the air bubble BA changes to a state shown in FIG. 16B. In the state shown in FIG. 16B, a large volume of the water is present near the jetting port 10*b* and a large number of swirling flows occur. Since the occurrence of the swirling flows resists the movement of the jet flow WSm, if swirl flows are suppressed as shown in FIG. 16A, it is possible to allow the jet flow WSm to move to the discharge port NZa without reducing the speed of the jet flow WSm.

Figure 17:
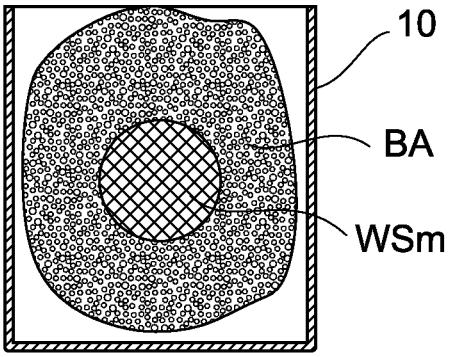
FIG. 17 is a diagram showing an E-E cross section of FIG. 15.

As shown in FIG. 17, the jet flow WSm pierces through the air bubble BA. Since the jet flow WSm pierces through the air bubble BA in this way, the resistance around the jet flow WSm falls. The jet flow WSm can move to the discharge port NZa without reducing the speed. However, the state in which the jet flow WSm completely pierces through the air bubble BA illustrated in FIG. 17 is not indispensable. Most parts around the jet flow WSm only have to be able to be surrounded by the air bubble BA. A part of the jet flow WSm may be in contact with the stored water PW.

Figure 18:
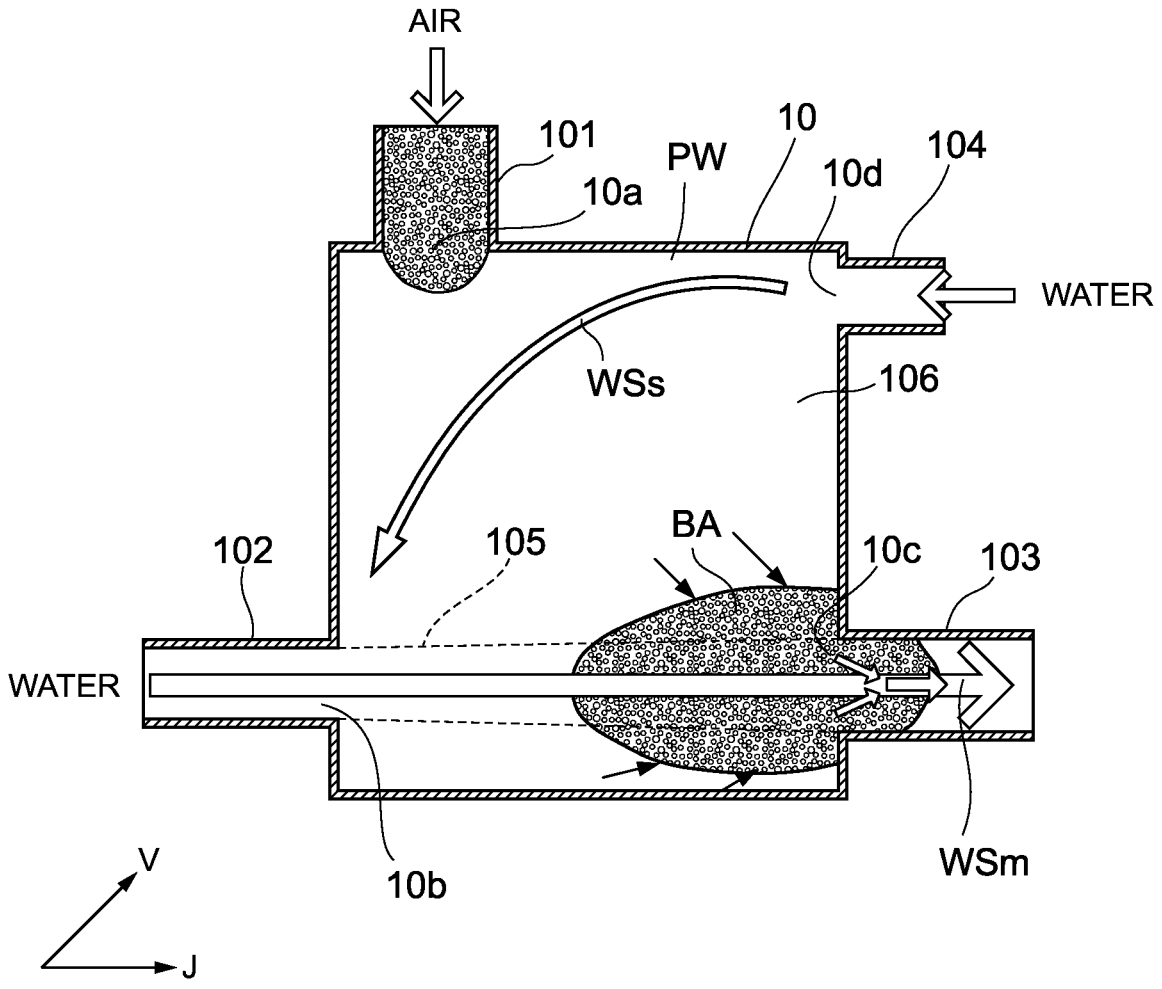
FIG. 18 is a diagram for explaining a form of supplying the air bubble to the jet flow in the water storage chamber shown in FIG. 4.

When time further elapses from the state shown in FIG. 15, as shown in FIG. 18, the air bubble BA moves to the discharge conduit 103 to be drawn into the jet flow WSm. Since the air bubble BA is formed to have a channel sectional area larger than that of the water passing path section 105, the air bubble BA moves to the discharge conduit 103 while being caught by the outer circumference of the water storage chamber side opening 10*c*. The air bubble BA caught by the outer circumference of the water storage chamber side opening 10*c* enters the discharge conduit 103 while being pushed in from the back by the jet flow WSm and pushed in by pressure received from the stored water PW.

Figure 19:
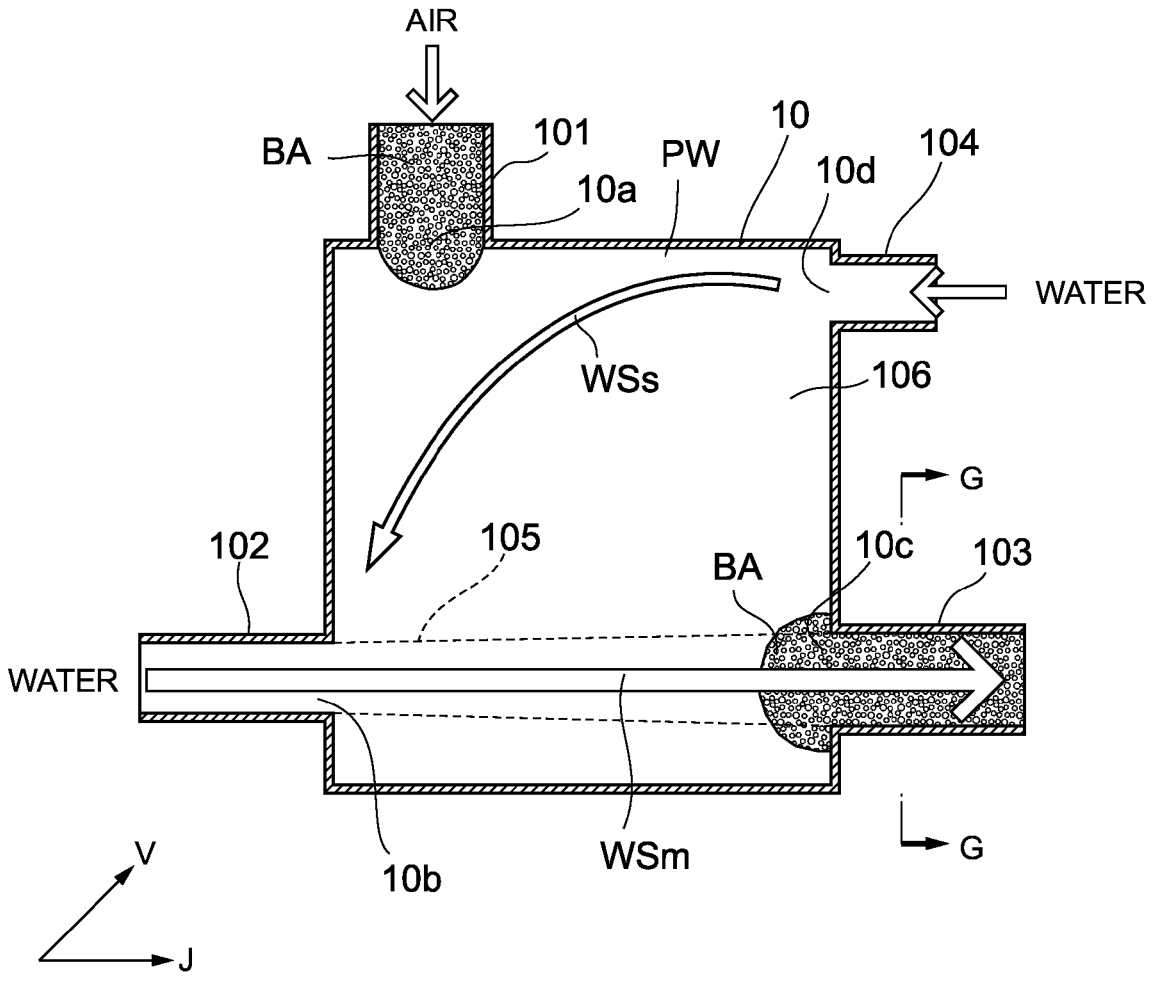
FIG. 19 is a diagram for explaining the form of supplying the air bubble to the jet flow in the water storage chamber shown in FIG. 4.
Figure 20:
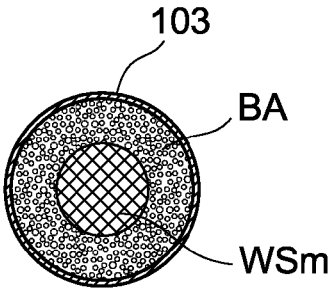
FIG. 20 is a diagram showing a G-G cross section of FIG. 19.

When time further elapses from the state shown in FIG. 18, as shown in FIG. 19, the air bubble BA enters the discharge conduit 103. A G-G cross section of FIG. 19 is shown in FIG. 20. As shown in FIG. 20, when the air bubble BA enters the discharge conduit 103, the air bubble BA forms a film of the air along the inner wall of the discharge conduit 103. The jet flow WSm moves in the film. Therefore, the resistance applied to the jet flow WSm from the inner wall of the discharge conduit 103 decreases. The jet flow WSm moves to the discharge port NZa without being decelerated. However, the state in which the air bubble BA completely surrounds the jet flow WSm illustrated in FIG. 15 is not indispensable. Most parts around the jet flow WSm only have to be able to be surrounded by the air bubble BA. A part of the jet flow WSm may be in contact with the discharge conduit 103.

When the air bubble BA moves to a downstream side of the discharge conduit 103 from the state shown in FIG. 19, the next air bubble BA is taken in from the air conduit 101 and the water storage chamber 10 returns to the state shown in FIG. 4. In this embodiment, the movement of the air bubble BA explained with reference to FIGS. 4 to 20 is periodically repeated.

In this embodiment, a second time from a point when the large air bubble BA generated earlier reaches the water passing path section 105 to a point when the large air bubble BA generated next reaches the water passing path section 105 is set longer than a first time from a point when the large air bubble BA generated earlier reaches the water passing path section 105 to a point when the entire large air bubble BA reaching the water passing path section 105 is discharged from the water passing path section 105.

Since the second time is set to be longer than the first time in this way, when the point when the large air bubble BA generated earlier reaches the water passing path section 105 is set as a reference, at the point when the large air bubble BA generated next reaches the water passing path section 105, the large air bubble BA generated earlier is always discharged from the water passing path section 105. Therefore, it is possible to surely generate a second water passing state in which the water passing path section 105 is filled with the water.

In this embodiment, the air lead-in port 10*a* that guides the large air bubble BA to the water passing path section 105 with the sub-water flow WSs and leads the air into the water storage chamber 10 and the walls 10*h*, 10*i*, and 10*j*, which are the guide surfaces functioning as resisting means for resisting the movement of the large air bubble BA guided from the air lead-in port 10*a* to the water passing path section 105 by the sub-water flow WSs are provided. The walls 10*h*, 10*i*, and 10*j* function as the guide surfaces that guide the air bubble BA from the air lead-in port 10*a* to the water passing path section 105.

In order to secure the second time long, it is necessary to slowly supply the air led in from the air lead-in port 10*a* to the water passing path section 105. However, the sub-water flow WSs is generated in the water storage chamber 10 according to the influence of the jet flow WSm. Therefore, the large air bubble BA is guided to the water passing path section 105 by the sub-water flow WSs. Therefore, the large air bubble BA is sometimes guided to the water passing path section 105 earlier than intended timing. It is also assumed that the second water passing state cannot be completely realized. Therefore, in this preferred form, the guide surfaces functioning as the resisting means for resisting the large air bubble BA guided to the water passing path section 105 by the sub-water flow are provided to adjust the moving speed of the large air bubble BA to appropriate speed and surely cause the second water passing state in which the water passing path section 105 is filled with the water.

In this embodiment, the large air bubble BA is guided to the water passing path section 105 while being pressed against the walls 10*h*, 10*i*, and 10*j*, which are the guide surfaces. Therefore, it is possible to continuously adjust the moving speed of the large air bubble BA from the air lead-in port 10*a* side to the water passing path section 105 making use of a frictional force generated between the guide surfaces and the large air bubble BA.

In this embodiment, the sub-water flow WSs is used to press the large air bubble BA against the walls 10*h*, 10*i*, and 10*j*, which are the guide surfaces. Therefore, it is possible to surely adjust the moving speed of the large air bubble BA without separately providing means for pressing the large air bubble BA against the guide surfaces.

In this embodiment, the vicinity of the air lead-in port 10*a* and the vicinity of the jetting port 10*b* are connected by the smooth continuous surface. Therefore, it is possible to more surely maintain the state in which the large air bubble BA is in contact with the guide surfaces.

In this embodiment, since the state in which the large air bubble BA is allowed to communicate with the air lead-in port 10*a* is maintained, the large air bubble BA and the sub-water flow WSs are in contact with each other in a portion other than a portion of the communication and a contact area of the large air bubble BA and the sub-water flow WSs decreases. Therefore, since the speed of the large air bubble BA moving to the water passing path section 105 can be reduced, it is possible to surely cause the second water passing state in which the water passing path section 105 is filled with the water.

Figure 21B:
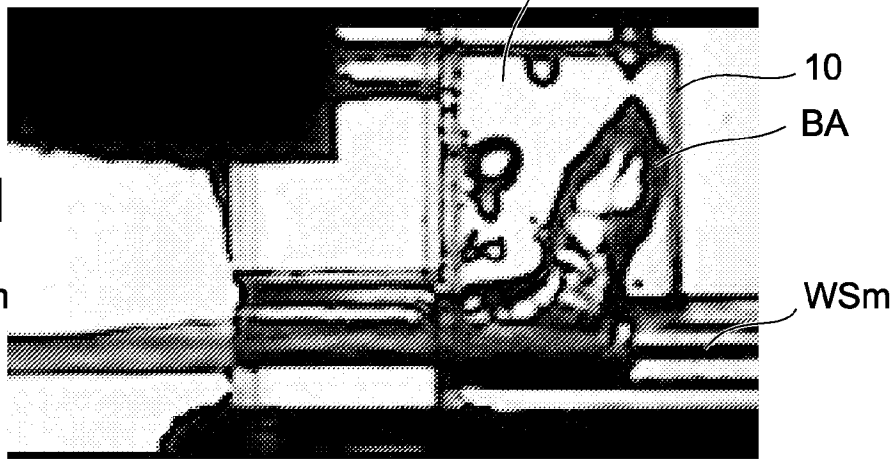
FIGS. 21A to 21C are diagrams showing photographs of a state in which the air bubble is actually supplied to the jet flow in the water storage chamber shown in FIG. 4.
Figure 21C:
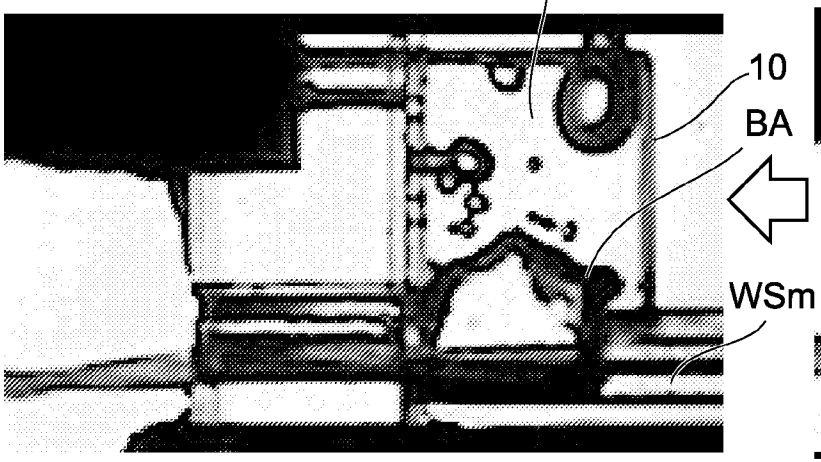
Figure 21A:
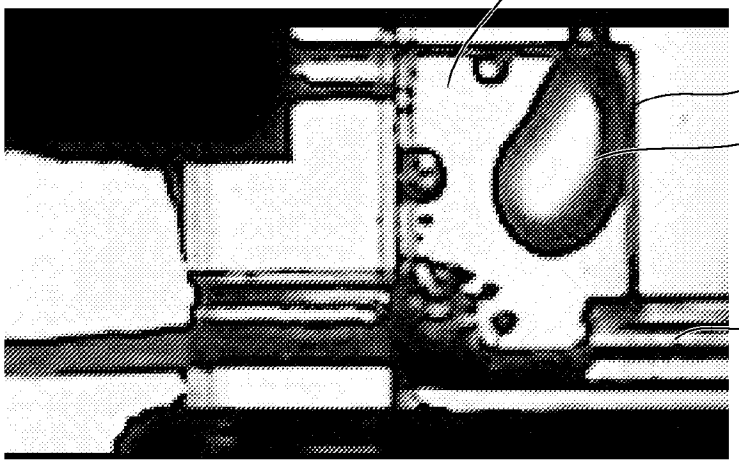

In FIGS. 21A to 21C, photographs obtained by photographing a state in which a water storage chamber equivalent to the water storage chamber 10 according to this embodiment is actually created and the water is supplied to the water storage chamber are shown. FIG. 21A shows a photograph obtained by photographing a state in which the jet flow WSm moves in the stored water PW and the air bubble BA grows. The state is equivalent to the state shown in FIG. 7. FIG. 21B shows a photograph obtained by photographing a state in which the jet flow WSm moves in the air bubble BA. The state is equivalent to the state shown in FIG. 14. FIG. 21C shows a photograph obtained by photographing a state in which the jet flow WSm moves in the air bubble BA. The state is equivalent to the state shown in FIG. 18.

As explained above, the water discharge device according to this embodiment is the local cleaning device WA. The local cleaning device WA discharges the water to a human body. The local cleaning device WA includes the first water supply conduit 102, which is the water supply path for supplying the water, the jetting port 10*b* configured to jet the water, which is supplied from the first water supply conduit 102, to the downstream side as the jet flow WSm, the discharge port NZa provided on the downstream side of the jetting port 10*b* and configured to discharge the jet flow WSm to the outside, the water storage chamber 10 provided between the jetting port 10*b* and the discharge port NZa and including the water passing path section 105, which is the path through which the jet flow WSm passes, extending from the jetting port 10*b* to the discharge port NZa and the water storing section 106 for forming the stored water PW to be adjacent to the water passing path section 105, and the air lead-in port 10*a* showing a function of at least a part of an air bubble supplying section that supplies the air bubble BA, which is formed by changing the air into a bubble shape, to the water passing path section 105.

The air bubble supplying section generates the large air bubble BA having a cross sectional area larger than the channel sectional area of the jetting port 10*b* when the water storage chamber 10 is viewed from the jetting port 10*b* (see FIG. 17). The air bubble supplying section intermittently forms the large air bubble BA to alternately and repeatedly generate the first water passing state in which the jet flow WSm pierces through the large air bubble BA (see FIG. 15) and the second water passing state in which the jet flow WSm passes through the water (see FIGS. 4, 7, etc.) to vary the water passing resistance of the jet flow WSm in the water passing path section 105.

In this embodiment, since the large air bubble BA having the cross sectional area larger than the channel sectional area of the jetting port 10*b* is intermittently formed, it is possible to alternately and repeatedly generate the first water passing state in which the jet flow WSm pierces through the large air bubble BA and the second water passing state in which the jet flow WSm passes through the water. In the first water passing state, since the jet flow WSm pierces through the large air bubble BA, a large volume of the air is present around the jet flow WSm, resistance for decelerating the jet flow WSm is weak, and the jet flow WSm moves to the discharge port NZa while the speed of the jet flow WSm is kept. On the other hand, in the second water passing state, since the jet flow WSm passes through the water, the water surround the jet flow WSm, resistance for decelerating the jet flow WSm is large, and the jet flow WSm moves to the discharge port NZa while the speed of the jet flow decreases. Therefore, by alternately and repeatedly generating the first water passing state and the second water passing state, it is possible to substantially vary the speed of the jet flow WSm moving to the discharge port NZa and give large flow speed variation to discharged water. Even if a distance from water discharge to water arrival is short, it is possible to form a sufficiently large water mass.

In this embodiment, the jet flow WSm is reduced in a diameter and jetted from the jetting port 10*b* such that the cross sectional area of the jet flow WSm is smaller than the cross sectional area of the large air bubble BA. Since the jet flow WSm is reduced in a diameter and jetted from the jetting port 10*b* in this way, the diffusion of the jet flow WSm is suppressed and it is possible to surely control the cross sectional area of the jet flow WSm. Therefore, it is possible to surely form a state in which the cross sectional area of the jet flow WSm is smaller than the cross sectional area of the large air bubble BA and surely realize the first water passing state. Therefore, it is possible to give large flow speed variation to discharged water.

In this embodiment, the air bubble supplying section supplies the large air bubble BA to near the jetting port 10*b* of the water passing path section 105. Since the large air bubble BA is supplied to near the jetting port 10*b* of the water passing path section 105 in this way, the large air bubble BA is extended to the discharge port NZa side by the jet flow WSm that pierces through the large air bubble BA. Therefore, it is possible to cause the large air bubble BA to be present in a long range from the jetting port 10*b* side to the discharge port NZa side according to a simple method of supplying the large air bubble BA to near the jetting port 10*b*. As a result, the length of the jet flow WSm that pierces through the large air bubble BA increases. It is possible to surely prevent deceleration of the jet flow WSm in the first water passing state and surely realize the first water passing state. Therefore, it is possible to give large flow speed variation to discharged water.

In this embodiment, in this embodiment, the air bubble supplying section supplies the large air bubble BA to cover the jetting port 10*b* (see FIGS. 16A and 16B). Since the large air bubble BA is supplied to cover the jetting port 10*b* in this way, it is possible to cover the vicinity of the jetting port 10*b* with the air. Therefore, in the first water passing state, generation of a swirl around the jetting port 10*b* is suppressed. It is possible to suppress disorder of the jet flow WSm due to the generation of a swirl. As a result, the movement of the jet flow WSm is stabilized. It is possible to surely realize the first water passing state. Therefore, it is possible to give large flow speed variation to discharged water.

In this embodiment, the air lead-in port 10*a* is provided in order to take the air into the water storage chamber 10 from the outside. The inner wall surface of the water storage chamber 10 functioning as the guide surface that extends from the air lead-in port 10*a* side to the water passing path section 105 side and facilitates the growth of the air bubble BA is provided near the air lead-in port 10*a* (see FIG. 8).

The air taken into the water storage chamber 10 from the air lead-in port 10*a* tends to be separated from the air lead-in port 10*a* and torn by the water flow in the water storage chamber 10 before changing to the large air bubble BA. Therefore, the bubble-like air taken in from the air lead-in port 10*a* is supported by the inner wall surface functioning as the guide surface provided near the air lead-in port 10*a*. Therefore, the growth of the air is facilitated even if the air is subjected to the force of water. It is possible to surely grow the air into the large air bubble BA. Therefore, since it is possible to surely realize the first water passing state, it is possible to give large flow speed variation to discharged water.

The air bubble supplying section according to this embodiment generates the large air bubble BA having a cross sectional area larger than the channel sectional area of the jetting port 10*b* in the discharge conduit 103. The air bubble supplying section alternately and repeatedly generates the first state in which the jet flow WSm passes through the air layer formed along the inner wall surface of the discharge conduit 103 by the large air bubble BA (see FIG. 20) and the second water passing state in which the jet flow WSm passes through the water supplied from the water storage chamber 10 to the discharge conduit 103 (see FIG. 6). The air bubble supplying section varies a contact area between the water flowing through the discharge conduit 103 and the inner wall surface of the discharge conduit 103.

According to this viewpoint, the air bubble supplying section intermittently generates the large air bubble BA having the cross sectional area larger than the channel sectional area of the jetting port 10*b* and supplies the large air bubble BA to the discharge conduit 103. Therefore, it is possible to alternately and repeatedly generate the first state in which the jet flow WSm passes through the air layer formed along the inner wall surface of the discharge conduit 103 and the second water passing state in which the jet flow WSm passes through the water supplied from the water storage chamber 10 to the discharge conduit 103. In the first water passing state, since the jet flow WSm passes through the air layer formed in the discharge conduit 103, a contact area between the inner wall surface of the discharge conduit 103 and the jet flow WSm decreases and frictional resistance applied to the jet flow WSm moving in the discharge conduit 103 decreases. On the other hand, in the second water passing state, since the jet flow WSm passes through the water supplied from the water storage chamber 10, a contact area between the inner wall surface of the discharge conduit 103 and the water including the jet flow WSm increases and the frictional resistance applied to the jet flow WSm moving in the discharge conduit 103 increases. Therefore, the first water passing state and the second water passing state are alternately and repeatedly generated to vary the contact area between the water flowing in the discharge conduit 103 and the inner wall surface of the discharge conduit 103. According to the variation of the frictional resistance, it is possible to substantially vary the speed of the jet flow WSm moving to the discharge port NZa and give large flow speed variation to discharged water. Even if a distance from water discharge to water arrival is short, it is possible to form a sufficiently large water mass.

Further, in the first water passing state, since the jet flow WSm passes through the air layer formed in the discharge conduit 103, when attention is paid to a flow of the entire water in the discharge conduit 103, a substantial channel sectional area decreases from that in the second water passing state. This is a factor explaining why the speed of the jet flow WSm passing through the discharge conduit 103 in the first water passing state is higher than the speed of the water passing through the discharge conduit 103 in the second water passing state. A flow speed variation effect for the discharged water due to the variation of the channel sectional area is added to the flow speed variation for the discharged water due to the variation of the frictional resistance explained above. Consequently, it is possible to give larger flow speed variation to discharged water.

In the embodiment, the air bubble supplying section generates the large air bubble BA to form a tubular air layer along the inner wall surface of the discharge conduit 103 to surround the jet flow WSm, which passes through the discharge conduit 103, along the moving direction of the jet flow WSm. Since the tubular air layer along the inner wall surface is formed to surround the jet flow WSm along the moving direction thereof in this way, it is possible to further reduce the contact area between the jet flow WSm and the inner wall surface of the discharge conduit 103. Therefore, it is possible to set the speed of the jet flow WSm in the first water passing state to be sufficiently higher than the speed of the water in the second water passing state and give large flow speed variation to discharged water.

In this embodiment, the air bubble supplying section supplies the large air bubble BA from the water passing path section 105 to the discharge conduit 103. The air bubble supplying section supplies the large air bubble BA to cover the outer circumference of the water storage chamber side opening 10*c*, which is an opening through which the discharge conduit 103 faces the water storage chamber 10.

Since the large air bubble BA is supplied from the water passing path section 105 side to cover the outer circumference of the water storage chamber side opening 10*c*, which is the opening through which the discharge conduit 103 faces the water storage chamber 10, in this way, it is possible to feed the large air bubble BA along the inner wall surface of the discharge conduit 103. Therefore, it is easy to form the tubular air layer along the inner wall surface of the discharge conduit 103. It is possible to give large flow speed variation to discharged water.

In this embodiment, the air bubble supplying section supplies the large air bubble BA from the water passing path section 105 to the discharge conduit 103. The air bubble supplying section supplies the large air bubble BA to have a cross sectional area larger than the channel sectional area of the discharge conduit 103 when the water passing path section 105 side is viewed from the discharge conduit 103 side.

Since the large air bubble BA is supplied to have a cross sectional area larger than the channel sectional area of the discharge conduit 103 in this way, it is possible to surely feed the large air bubble BA along the inner wall surface of the discharge conduit 103. Therefore, it is easy to more surely form the tubular air layer along the inner wall surface of the discharge conduit 103. It is possible to give large flow speed variation to discharged water.

In this embodiment, when the air bubble supplying section supplies the large air bubble BA from the water passing path section 105 to the discharge conduit 103, the air bubble supplying section supplies the large air bubble BA while temporarily holding up the large air bubble BA. When the large air bubble BA is supplied from the water passing path section 105 to the discharge conduit 103, since the large air bubble BA is supplied while being temporarily held up, in this way, it is easy to feed the large air bubble BA along the inner wall surface of the discharge conduit 103. Therefore, it is easier to more surely form the tubular air layer along the inner wall surface of the discharge conduit 103. It is possible to give large flow speed variation to discharged water.

In this embodiment, the air bubble supplying section preferably generates and supplies the large air bubble BA such that an air layer is formed at length substantially equal to the length of the discharge conduit 103 along the moving direction of the jet flow WSm. In this preferred form, since the large air bubble BA is supplied such that the air layer can be formed throughout the length of discharge conduit 103, the tubular air layer can be formed from the water storage chamber 10 to the discharge port NZa. Therefore, in the first water passing state, it is possible to reduce the frictional resistance applied to the jet flow WSm when the jet flow WSm moves from the water storage chamber 10 to the discharge port NZa to be extremely small and give large flow speed variation to discharged water.

In this embodiment, the jetting port 10*b* and the discharge conduit 103 are arranged such that the center axis of the jet flow WSm jetted from the jetting port 10*b* is located on substantially the same straight line as the center axis of the discharge conduit 103. The channel sectional area of the discharge conduit 103 is formed larger than the channel sectional area of the jetting port 10*b*.

Since the center axis of the jet flow WSm jetted from the jetting port 10*b* is arranged to be located on substantially the same straight line as the center axis of the discharge conduit 103, it is possible to align the center of the discharge conduit 103 and the center of the jet flow WSm jetted into the discharge conduit 103. Further, since the channel sectional area of the discharge conduit 103 is formed larger than the channel sectional area of the jetting port 10*b*, it is possible to surely keep a gap between the jet flow WSm and the inner wall surface of the discharge conduit 103. Therefore, it is possible to form the tubular air layer in the gap and surely feed the jet flow WSm through the tubular air layer.

The air bubble supplying section according to this embodiment grows the air led into the water storage chamber 10 from the air lead-in port 10*a* into a large bubble shape as time elapses and, at a stage when the air bubble BA reaches a predetermined size, supplies the air bubble BA to the water passing path section 105 as the large air bubble BA. Further, until the air led in from the air lead-in port 10*a* is grown to the large air bubble BA and supplied to the water passing path section 105, the air bubble supplying section alternately and repeatedly generates a first water flow state and a second water flow state. The first water flow state is a state in which the sub-water flow WSs having a relatively low flow speed, which can maintain a state in which the air lead-in port 10*a* and the air bubble BA communicate with each other, is formed in the water storage chamber 10 (see FIGS. 4 and 7). The second water flow state is a state in which the sub-water flow WSs having a relative high flow speed, which can separate the air bubble BA from the air lead-in port 10*a* such that the air led in from the air lead-in port 10*a* is grown into the large air bubble BA and supplied to the water passing path section 105, is formed in the water storage chamber 10 (see FIG. 14).

According to this viewpoint, in the first water flow state, the sub-water flow WSs having a relatively low flow speed, which can maintain a state in which the air lead-in port 10*a* and the air bubble BA communicate with each other, is formed in the water storage chamber 10. Therefore, it is possible to grow the air bubble BA formed by the air led in from the air lead-in port 10*a* without tearing off the air bubble BA. On the other hand, in the second water flow state, the sub-water flow WSs having a relatively high flow speed, which can separate the air bubble BA from the air lead-in port 10*a* such that the air led in from the air lead-in port 10*a* is grown into the large air bubble BA and supplied to the water passing path section 105, is formed in the water storage chamber 10. Therefore, it is possible to separate the air bubble BA grown in the first water flow state and supply the air bubble BA as the large air bubble BA to the water passing path section 105. Since the first water flow state and the second water flow state are alternately and repeatedly generated, it is possible to alternately and repeatedly generate a period in which the large air bubble BA is not supplied to the jet flow WSm and a period in which the large air bubble BA is supplied to the jet flow WSm. In the period in which the large air bubble BA is supplied to the jet flow WSm, the jet flow WSm moves to the discharge port NZa while the speed of the jet flow WSm is kept. On the other hand, in the period in which the large air bubble BA is not supplied to the jet flow WSm, the jet flow WSm moves to the discharge port NZa while the speed of the jet flow WSm decreases. Therefore, since the first water flow state and the second water flow state are alternately and repeatedly generated, it is possible to substantially vary the speed of the jet flow WSm moving to the discharge port NZa and give large flow speed variation to discharged water. Even if a distance from water discharge to water arrival is short, it is possible to form a sufficiently large water mass.

In this embodiment, in the water storage chamber 10, the inner wall of the water storage chamber 10 extending from the air lead-in port 10*a* side to the water passing path section 105 side and functioning as the guide surface for facilitating the growth of the air bubble BA is provided. The air bubble supplying section guides the air bubble BA, which is formed by the air led in from the air lead-in port 10*a*, to near the water passing path section 105 while keeping a state in which the air bubble BA is set in contact with the inner wall functioning as the guide surface (see FIGS. 7 and 8).

An air-water interface, which is a boundary between the air and the water, tends to be deformed because the air-water interface is formed according to a balance of powers that the air and the water causes to act on each other. When the balance of powers is lost, the air-water interface collapses. Therefore, in the first water flow state, which is the period in which the air bubble BA is grown, it is necessary for stably growing the air bubble BA to keep the area of the air-water interface, where the air and the water are in contact, as small as possible. Therefore, a state in which the air bubble BA formed by the air led in from the air lead-in port 10*a* is set in contact with the inner wall functioning as the guide surface. Consequently, it is possible to reduce the area of the air-water interface from the air lead-in port 10*a* side to the water passing path section 105 side, maintain a communication state of the air lead-in port 10*a* and the air bubble BA being grown, and facilitate a stable air bubble growth.

In this embodiment, the air bubble supplying section guides, with the sub-water flow WSs in the first water flow state, the air bubble BA formed by the air, which is led in from the air lead-in port 10*a*, to near the water passing path section 105 while pressing the air bubble BA toward the inner wall functioning as the guide surface (see FIGS. 7 and 9).

In the water storage chamber 10, a negative pressure is generated because the jet flow WSm is jetted from the jetting port 10*b* to the discharge port NZa. Since the negative pressure acts on the air bubble BA formed in the water storage chamber 10, the air bubble BA is likely to receive force for separating the air bubble BA from the wall surface functioning as the guide surface. Therefore, the air bubble BA is pressed toward the wall surface functioning as the guide surface by the sub-water flow WSs in the first water flow state. Therefore, the air bubble BA is not separated from the wall surface functioning as the guide surface even if the negative pressure acts on the air bubble BA. It is possible to reduce the area of the air-water interface from the air lead-in port 10*a* side to the water passing path section 105 side, maintain the communication state of the air lead-in port 10*a* and the air bubble BA being grown, and facilitate a stable air bubble growth.

In this embodiment, the air bubble supplying section guides, with the sub-water flow WSs in the first water flow state, the air bubble BA formed by the air, which is led in from the air lead-in port 10*a*, to near the water passing path section 105 while pressing the air bubble BA in a direction against buoyancy acting on the air bubble BA (see FIG. 9).

Since the buoyancy acting on the air bubble BA being grown and the sub-water flow WSs formed to press the air bubble BA in the direction against the buoyancy are balanced in this way, it is possible to stably grow the air bubble BA. For example, even if the flow speed of the sub-water flow WSs in the first water flow state is slightly high, an excess of the force of the sub-water flow WSs for pressing the air bubble BA against the wall surface functioning as the guide surface can be reduced by the buoyancy of the air bubble BA. Therefore, it is possible to eliminate an excessive influence due to the sub-water flow WSs, maintain the communication state of the air lead-in port 10*a* and the air bubble BA being grown, and facilitate a stable air bubble growth.

In this embodiment, the guide surface includes a first surface against which an air bubble is pressed and a second surface and a third surface arranged to be opposed to each other across the first surface (see FIG. 8). Since the guide surface includes the first surface, the second surface, and the third surface in this way, it is possible to bring the air bubble BA formed by the air, which is led in from the air lead-in port 10*a*, into contact with the second surface and the third surface while pressing the air bubble BA against the first surface. Therefore, it is possible to reduce the area of the air-water interface on which the sub-water flow WSs and the air bubble BA are in contact with each other, maintain the communication state of the air lead-in port 10*a* and the air bubble BA being grown, and facilitate a stable air bubble growth.

In this embodiment, the sub-water flow is led into the water storage chamber 10 from the sub-water flow lead-in port 10*d* formed separately and independently from the jetting port 10*b*. Since the sub-water flow WSs is led in from the sub-water flow lead-in port 10*d* formed separately and independently from the jetting port 10*b* in this way, compared with the sub-water flow WSs generated by separating the water led in from the jetting port 10*b*, it is easy to control the flow speed of the sub-water flow WSs to lower speed. Therefore, it is possible to maintain the communication state of the air lead-in port 10*a* and the air bubble BA being grown and facilitate a stable air bubble growth.

In this embodiment, the sub-water flow WSs presses, in a state in which the sub-water flow WSs does not interfere with the jet flow WSm, the air bubble BA formed by the air, which is led in from the air lead-in port 10*a*, against the guide surface. Since the sub-water flow WSs is caused to act on the air bubble BA in the state in which the sub-water flow WSs does not interfere with the jet flow WSm in this way, the sub-water flow WSs is not accelerated by the action of the jet flow WSm. Therefore, the sub-water flow WSs is not excessively accelerated to tear off the air bubble BA in the first water flow state. Therefore, it is possible to maintain the communication state of the air lead-in port 10*a* and the air bubble BA being grown and facilitate a stable air bubble growth.

In this embodiment, the size of the air lead-in port 10*a* is set to a size for preventing the communication state of the air bubble BA formed by the air, which is led in from the air lead-in port 10*a*, with the air lead-in port 10*a* from being cut by the sub-water flow WSs in the first water flow state.

When an air bubble is grown in the first water flow state, if the air bubble BA and the sub-water flow WSs come into contact with each other, the air bubble BA is deformed. Therefore, since the size of the air lead-in port 10*a* is set to a size for preventing the communication state with the air lead-in port 10*a* from being cut by the sub-water flow WSs in the first water flow state, even if the air bubble BA is deformed by the action of the sub-water flow WSs, it is possible to maintain the communication state of the air lead-in port 10*a* and the air bubble BA being grown and supply the large air bubble BA.

The air bubble supplying section according to this embodiment generates the large air bubble BA having a cross sectional area larger than the channel sectional area of the jetting port 10*b* when the inside of the water storage chamber 10 is viewed from the jetting port 10*b*. The air bubble supplying section intermittently forms and supplies the large air bubble BA to the water passing path section 105 to alternately and repeatedly generate a first state in which the jet flow WSm is pressurized and accelerated and a second state in which the jet flow WSm is not accelerated.

According to such a viewpoint, since the air bubble BA having the cross sectional area larger than the channel sectional area of the jetting port 10*b* is intermittently formed, it is possible to alternately and repeatedly generate the first state in which the jet flow WSm is pressurized and accelerated and the second state in which the jet flow WSm is not accelerated. In the first state, since the jet flow WSm is pressurized and accelerated, the jet flow WSm moves to the discharge port NZa while the speed of the jet flow WSm increases. On the other hand, in the second state, since the jet flow WSm is not accelerated, the jet flow WSm moves to the discharge port NZa while the speed of the jet flow WSm does not increase. Therefore, since the first state and the second state are alternately and repeatedly generated, it is possible to substantially vary the speed of the jet flow WSm moving to the discharge port NZa and give large flow speed variation to discharged water. Even if a distance from water discharge to water arrival is short, it is possible to form a sufficiently large water mass.

In this embodiment, in the first state, the air bubble BA is pressurized by the jet flow WSm from the further upstream side than the air bubble BA supplied to the water passing path section 105 and the pressurized large air bubble BA pressurizes and accelerates the jet flow WSm on the downstream side of the large air bubble BA (see FIG. 18). Since the large air bubble BA pressurized by the jet flow WSm pressurizes the jet flow WSm further on the downstream side in this way, the jet flow WSm is further accelerated in the first state. It is possible to substantially vary the speed of the jet flow WSm and give large flow speed variation to discharged water.

In this embodiment, in the first state, when the large air bubble BA supplied to the water passing path section 105 is discharged from the discharge port NZa, the jet flow WSm discharged from the discharge port NZa is pressurized and accelerated. In this way, when the large air bubble BA supplied to the water passing path section 105 is discharged from the discharge port NZa, the jet flow WSm discharged from the discharge port NZa is pressurized and accelerated making use of force opened to the atmosphere and flowing out. Therefore, the jet flow WSm is further accelerated in the first state. It is possible to substantially vary the speed of the jet flow WSm and give large flow speed variation to discharged water.

In this embodiment, in the first state, when the large air bubble BA supplied to the water passing path section 105 is discharged to the discharge port NZa, the large air bubble BA is supplied to have a size for covering the water storage chamber side opening 10*c* of the discharge conduit 103 extending from the water storage chamber 10 to the discharge port NZa.

Since the large air bubble BA is supplied to have a size for covering the water storage chamber side opening 10*c* when the large air bubble BA is discharged from the water storage chamber 10 to the discharge port NZa in this way, the large air bubble BA is not discharged without resistance and is discharged while being temporarily receiving resistance from the water storage chamber side opening 10*c*. Therefore, in that process, the large air bubble BA receives pressure from the jet flow WSm and the internal pressure of the large air bubble BA rises. As a result, in the first state, the jet flow WSm receives a larger pressure from the large air bubble BA to be pressurized and accelerated. It is possible to substantially vary the speed of the jet flow WSm and give large flow speed variation to the discharged water.

In the embodiment, the sub-water flow lead-in port 10*d* is provided separately and independently from the jetting port 10*b* in order to form the sub-water flow WSs. However, it is also preferable to form the sub-water flow WSs without providing the sub-water flow lead-in port 10*d*. A modification from this viewpoint is explained with reference to FIG. 22 and FIGS. 23A and 23B.

Figure 22:
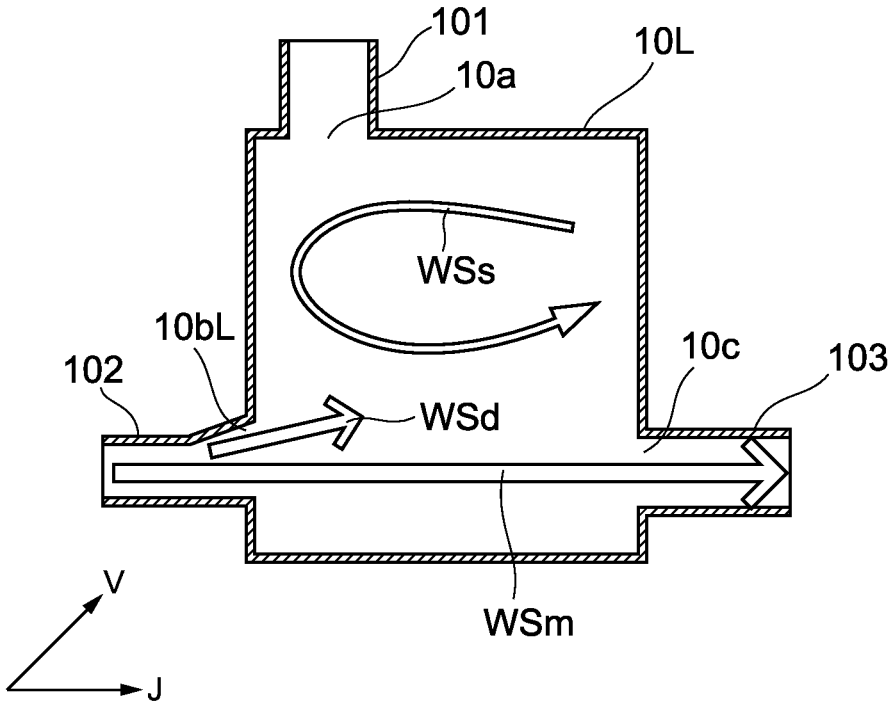
FIG. 22 is a diagram showing a modification in which a sub-water flow is formed in the water storage chamber.
Figure 23A:
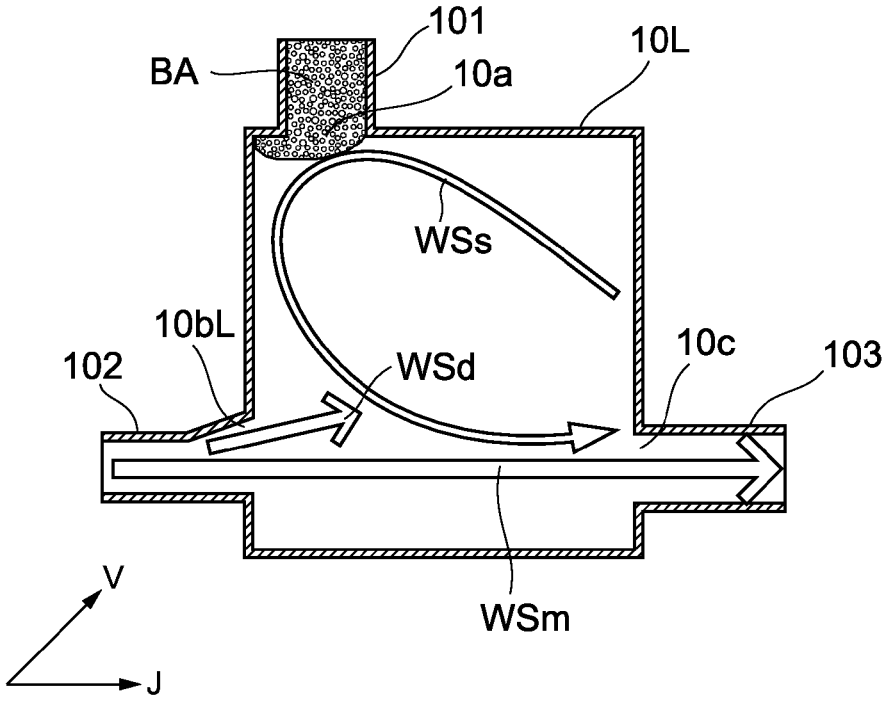
FIGS. 23A and 23B are diagrams for explaining transition of a way of flow of the sub-water flow in the modification shown in FIG. 22.
Figure 23B:
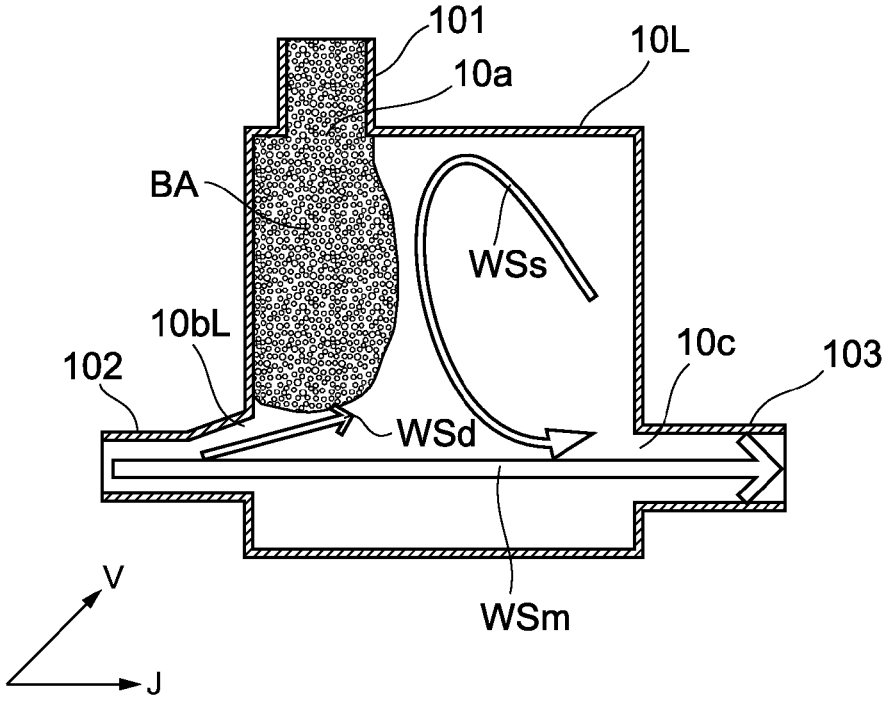

FIG. 22 is a diagram showing a water storage chamber 10L according to a modification for forming the sub-water flow WSs in the water storage chamber 10. FIGS. 23A and 23B are diagrams for explaining transition of a way of flow of the sub-water flow WSs in the modification shown in FIG. 22.

In the water storage chamber 10L, the sub-water flow lead-in port 10*d* of the water storage chamber 10 is removed and the jetting port 10*b* is expanded in a diameter to form a jetting port 10*b*L. The jetting port 10*b*L expanded in a diameter is formed in this way to change the direction of a part of the jet flow WSm and form the sub-water flow WSs as a split flow WSd.

As shown in FIG. 23A, at a stage when the air bubble BA is small, since the pressure in the water storage chamber 10L is low, a split flow amount of the split flow WSd is relatively large and a flow rate of the sub-water flow WSs is large. On the other hand, as shown in FIG. 23B, when the air bubble BA becomes large, the pressure in the water storage chamber 10L rises, the split flow amount of the split flow WSd decreases, and the flow rate of the sub-water flow WSs decreases.

Figure 24:
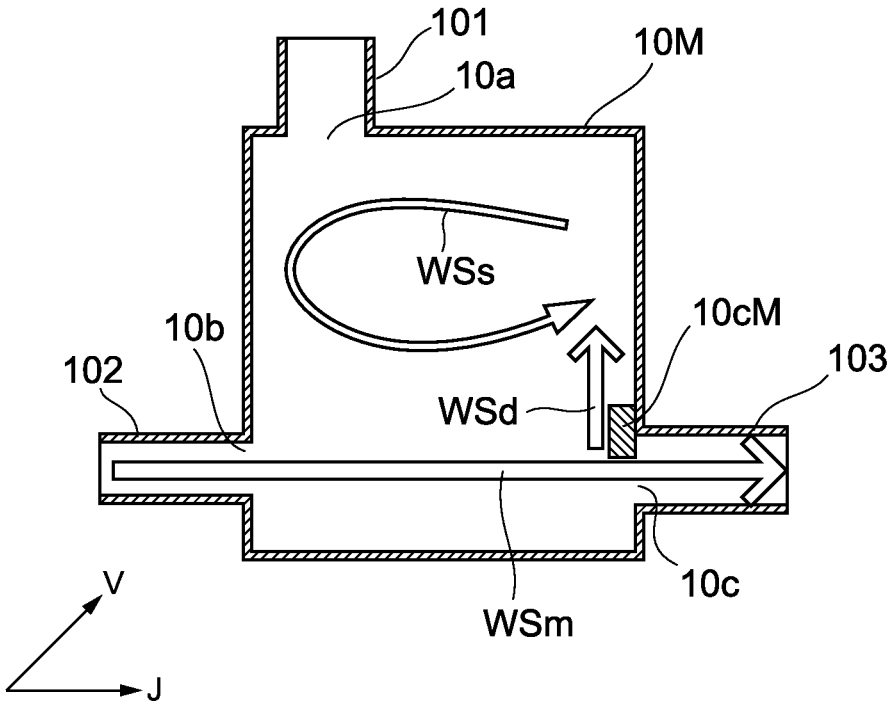
FIG. 24 is a diagram showing a modification in which a sub-water flow is formed in the water storage chamber.

FIG. 24 is a diagram showing a water storage chamber 10M according to a modification for forming the sub-water flow WSs in the water storage chamber 10. In the water storage chamber 10M, the sub-water flow lead-in port 10*d* of the water storage chamber 10 is removed and a reduced-diameter member 10*c*M is provided to close a part of the water storage chamber side opening 10*c*. When the water storage chamber 10M is configured in this way, the direction of a part of the jet flow WSm is changed by the reduced-diameter member 10*c*M to form the sub-water flow WSs as the split flow WSd.

Figure 25B:
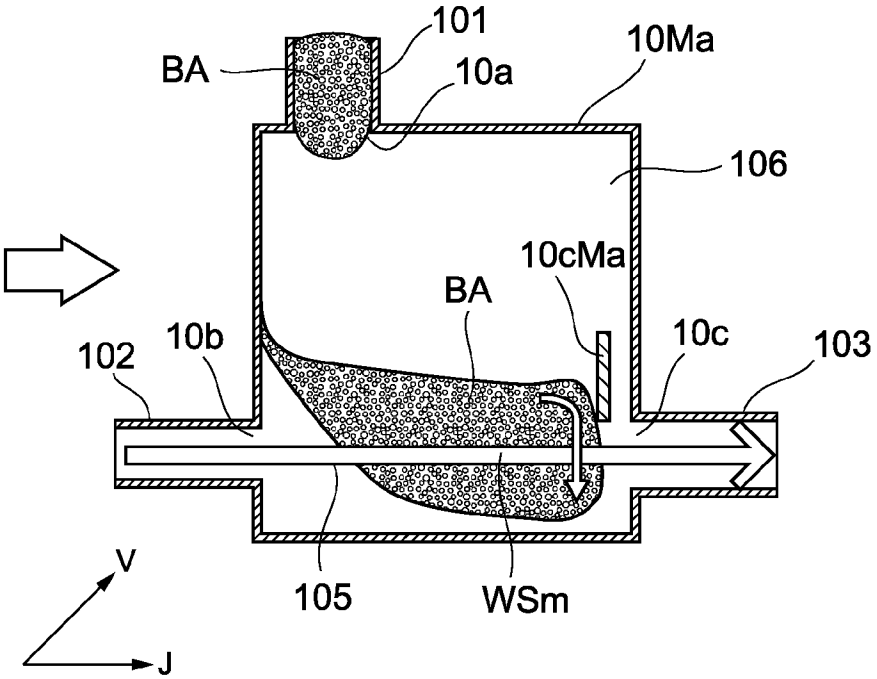
FIGS. 25A to 25B are diagrams showing an example in which a large air bubble discharge suppressing section is provided in the water storage chamber.
Figure 25A:
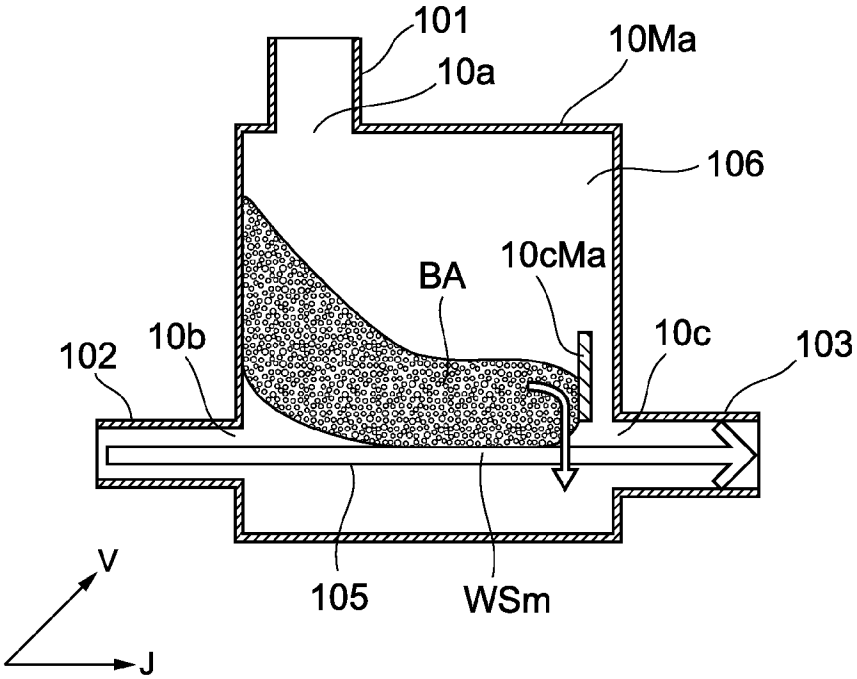

FIGS. 25A to 25B are diagrams showing a water storage chamber 10Ma in which a reduced-diameter member 10*c*Ma is provided as a large air bubble discharge suppressing section. In the water storage chamber 10Ma, the sub-water flow lead-in port 10*d* of the water storage chamber 10 is removed and the reduced-diameter member 10*c*Ma is provided to close a part of the water storage chamber side opening 10*c*. When the water storage chamber 10Ma is configured in this way, the large air bubble discharge suppressing section can be realized by a simple configuration in which the channel sectional area of the water storage chamber side opening 10*c* is set smaller than the cross sectional area of the large air bubble BA. Therefore, it is possible to cause the large air bubble BA to move around to the circumference of the jet flow WSm with a simple configuration.

The water storage chamber 10Ma is configured such that the jet flow WSm jetted from the jetting port 10*b* moves to a discharge port without interfering with the inner wall of the water storage chamber 10Ma and the reduced-diameter member 10*c*Ma, which is the large air bubble discharge suppressing section.

Since the water storage chamber 10Ma is configured in this way, it is possible to suppress a situation in which the moving direction of the jet flow WSm is excessively changed by the inner wall of the water storage chamber 10Ma and the reduced-diameter member 10*c*Ma and a large flow occurs in the water storing section 106 in the water discharge port side (the water storage chamber side opening 10*c* side) of the water passing path section 105. Therefore, it is possible to suppress the large air bubble BA supplied to the water passing path section 105 and held up by the action of the reduced-diameter member 10*c*Ma, which is the large air bubble discharge suppressing section, from flowing back to the water storing section 106. It is possible to contribute to smooth alternate generation of the first water passing state and the second water passing state.

As explained above, in the water storage chamber 10Ma, the large air bubble BA is supplied to a position near the jetting port 10*b* of the water passing path section 105. The reduced-diameter member 10*c*Ma temporarily holds up the large air bubble BA in a position near the water discharge port (the water storage chamber side opening 10*c* side) of the water passing path section 105.

Since the large air bubble BA is supplied to near the jetting port 10*b* of the water passing path section 105 (see FIG. 25A) in this way, the large air bubble BA is extended to the discharge port side (the water storage chamber side opening 10*c* side) by the jet flow WSm jetted from the jetting port 10*b*. Therefore, it is possible to cause the large air bubble BA to be present in a long range from the jetting port 10*b* side to the discharge port side (the water storage chamber side opening 10*c* side) according to a simple method of supplying the large air bubble BA to near the jetting port 10*b*. As a result, the length of the jet flow WSm that pierces through the large air bubble BA increases. It is possible to more surely prevent deceleration of the jet flow WSm in the first water passing state and surely realize the first water passing state. Therefore, it is possible to give large flow speed variation to discharged water.

Further, since the large air bubble BA is temporarily held up in the position near the water discharge port (the water storage chamber side opening 10*c*) of the water passing path section 105, the large air bubble BA supplied to the water passing path section 105 accumulates while moving to near the water discharge port (the water storage chamber side opening 10*c*). Therefore, the large air bubble BA is not present near the jetting port 10*b* of the water passing path section 105, which is a supply section for the large air bubble BA. Even if a large air bubble of the next cycle is supplied to the water passing path section 105, it is possible to suppress the large air bubble from coming into contact with and being connected to the large air bubble BA of the preceding cycle. Therefore, it is possible to surely generate the first water passing state and the second water passing state alternately.

In this embodiment, it is indispensable for forming a sufficiently large water mass to more surely cause variation of water passing resistance. To form a sufficiently large water mass, it is necessary that, in the first water passing state, the large air bubble BA is arranged in a section from a place extremely close to the jetting port 10*b* to a place extremely close to the discharge port (the water storage chamber side opening 10*c*). For example, when the length of the water passing path section 105 cannot be sufficiently secured or the flow speed of the jet flow WSm is high, it is also assumed that the large air bubble BA supplied to the water passing path section 105 cannot be held up enough for forming the first water passing state for a sufficient time.

Therefore, the reduced-diameter member 10*c*Ma is provided as the large air bubble discharge suppressing section that suppresses the large air bubble BA, which moves along the circumference of the jet flow WSm, from moving to the discharge port side (moving beyond the water storage chamber side opening 10*c*) and temporarily holds up the large air bubble BA around the water passing path section 105. Since the large air bubble discharge suppressing section is provided in this way, the large air bubble BA supplied to the water passing path section 105 accumulates around the water passing path section 105 without being immediately discharged. Therefore, the large air bubble BA easily moves around to the circumference of the jet flow WSm. It is possible to surely form the first water passing state in which the jet flow WSm passes through the large air bubble BA. Since the second water passing state and the first water passing state are alternately generated, it is possible to surely generate flow speed variation of the discharged water. In this way, it is possible to substantially vary the speed of the jet flow moving to the discharge port and give large flow speed variation to discharged water. Even if a distance from water discharge to water arrival is short, it is possible to form a sufficiently large water mass.

Figure 26B:
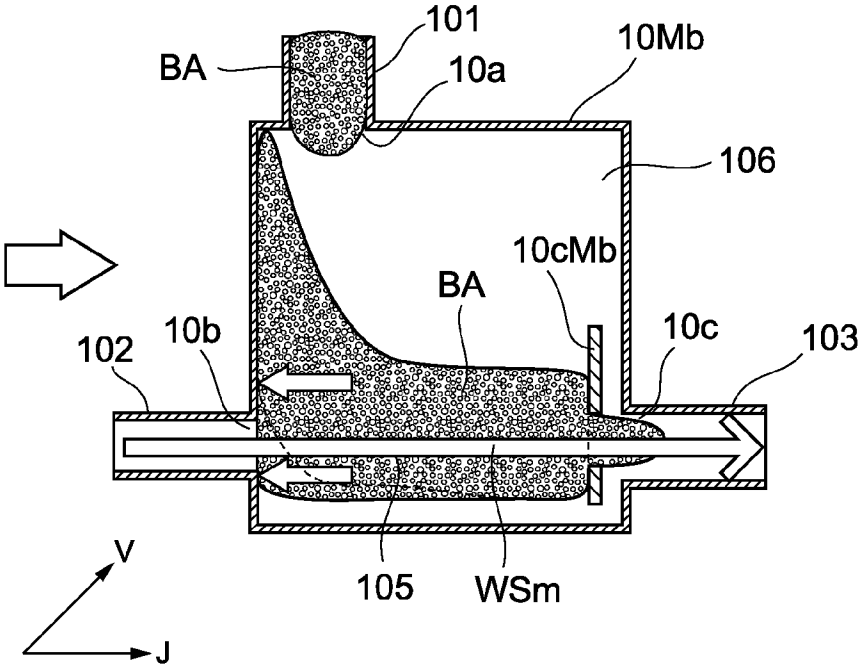
FIGS. 26A to 26B are diagrams showing an example in which the large air bubble discharge suppressing section is provided in the water storage chamber.
Figure 26A:
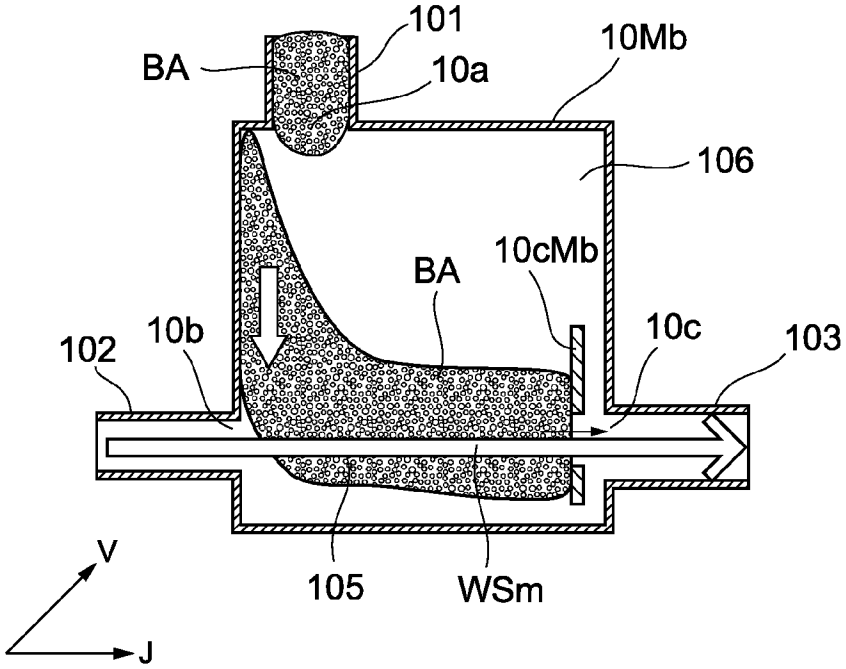

FIGS. 26A to 26C are diagrams showing a water storage chamber 10Mb in which a reduced-diameter member 10*c*Mb is provided as the large air bubble discharge suppressing section. In the water storage chamber 10Mb, the sub-water flow lead-in port 10*d* of the water storage chamber 10 is removed and the reduced-diameter member 10*c*Mb is provided to close a part of the water storage chamber side opening 10*c*. Since the water storage chamber 10Mb is configured in this way, the large air bubble discharge suppressing section can be realized by a simple configuration in which the channel sectional area of the water storage chamber side opening 10*c* is set smaller than the cross sectional area of the large air bubble BA. Therefore, it is possible to cause the large air bubble BA to move around to the circumference of the jet flow WSm with a simple configuration.

The water storage chamber 10Mb is configured such that the jet flow WSm jetted from the jetting port 10*b* moves to a discharge port without interfering with the inner wall of the water storage chamber 10Mb and the reduced-diameter member 10*c*Mb, which is the large air bubble discharge suppressing section.

Since the water storage chamber 10Mb is configured in this way, it is possible to suppress a situation in which the moving direction of the jet flow WSm is excessively changed by the inner wall of the water storage chamber 10Mb and the reduced-diameter member 10*c*Mb and a large flow occurs in the water storing section 106 in the water discharge port side (the water storage chamber side opening 10*c* side) of the water passing path section 105. Therefore, it is possible to suppress the large air bubble BA supplied to the water passing path section 105 and held up by the action of the reduced-diameter member 10*c*Mb, which is the large air bubble discharge suppressing section, from flowing back to the water storing section 106. It is possible to contribute to smooth alternate generation of the first water passing state and the second water passing state.

As explained above, in the water storage chamber 10Mb, the large air bubble BA is supplied to a position near the jetting port 10*b* of the water passing path section 105. The reduced-diameter member 10*c*Mb temporarily holds up the large air bubble BA in a position near the water discharge port (the water storage chamber side opening 10*c* side) of the water passing path section 105.

Since the large air bubble BA is supplied to near the jetting port 10*b* of the water passing path section 105 (see FIG. 26A) in this way, the large air bubble BA is extended to the discharge port side (the water storage chamber side opening 10*c* side) by the jet flow WSm jetted from the jetting port 10*b*. Therefore, it is possible to cause the large air bubble BA to be present in a long range from the jetting port 10*b* side to the discharge port side (the water storage chamber side opening 10*c* side) according to a simple method of supplying the large air bubble BA to near the jetting port 10*b*. As a result, the length of the jet flow WSm that pierces through the large air bubble BA increases. It is possible to more surely prevent deceleration of the jet flow WSm in the first water passing state and surely realize the first water passing state. Therefore, it is possible to give large flow speed variation to discharged water.

Further, since the large air bubble BA is temporarily held up in the position near the water discharge port (the water storage chamber side opening 10*c*) of the water passing path section 105 (see FIG. 26B), the large air bubble BA supplied to the water passing path section 105 accumulates while moving to near the water discharge port (the water storage chamber side opening 10*c*). Therefore, since the large air bubble BA is suppressed from moving to the discharge port side and the large air bubble BA is extended to the jetting port 10*b* side. Therefore, it is possible to more surely supply the large air bubble BA to the end on the jetting port 10*b* side of the water passing path section 105.

In this embodiment, it is indispensable for forming a sufficiently large water mass to more surely cause variation of water passing resistance. To form a sufficiently large water mass, it is necessary that, in the first water passing state, the large air bubble BA is arranged in a section from a place extremely close to the jetting port 10*b* to a place extremely close to the discharge port (the water storage chamber side opening 10*c*). For example, when the length of the water passing path section 105 cannot be sufficiently secured or the flow speed of the jet flow WSm is high, it is also assumed that the large air bubble BA supplied to the water passing path section 105 cannot be held up enough for forming the first water passing state for a sufficient time.

Therefore, the reduced-diameter member 10*c*Mb is provided as the large air bubble discharge suppressing section that suppresses the large air bubble BA, which moves along the circumference of the jet flow WSm, from moving to the discharge port side (moving beyond the water storage chamber side opening 10*c*) and temporarily holds up the large air bubble BA around the water passing path section 105. Since the large air bubble discharge suppressing section is provided in this way, the large air bubble BA supplied to the water passing path section 105 accumulates around the water passing path section 105 without being immediately discharged. Therefore, the large air bubble BA easily moves around to the circumference of the jet flow WSm. It is possible to surely form the first water passing state in which the jet flow WSm passes through the large air bubble BA. Since the second water passing state and the first water passing state are alternately generated, it is possible to surely generate flow speed variation of the discharged water. In this way, it is possible to substantially vary the speed of the jet flow moving to the discharge port and give large flow speed variation to discharged water. Even if a distance from water discharge to water arrival is short, it is possible to form a sufficiently large water mass.

Figure 27:
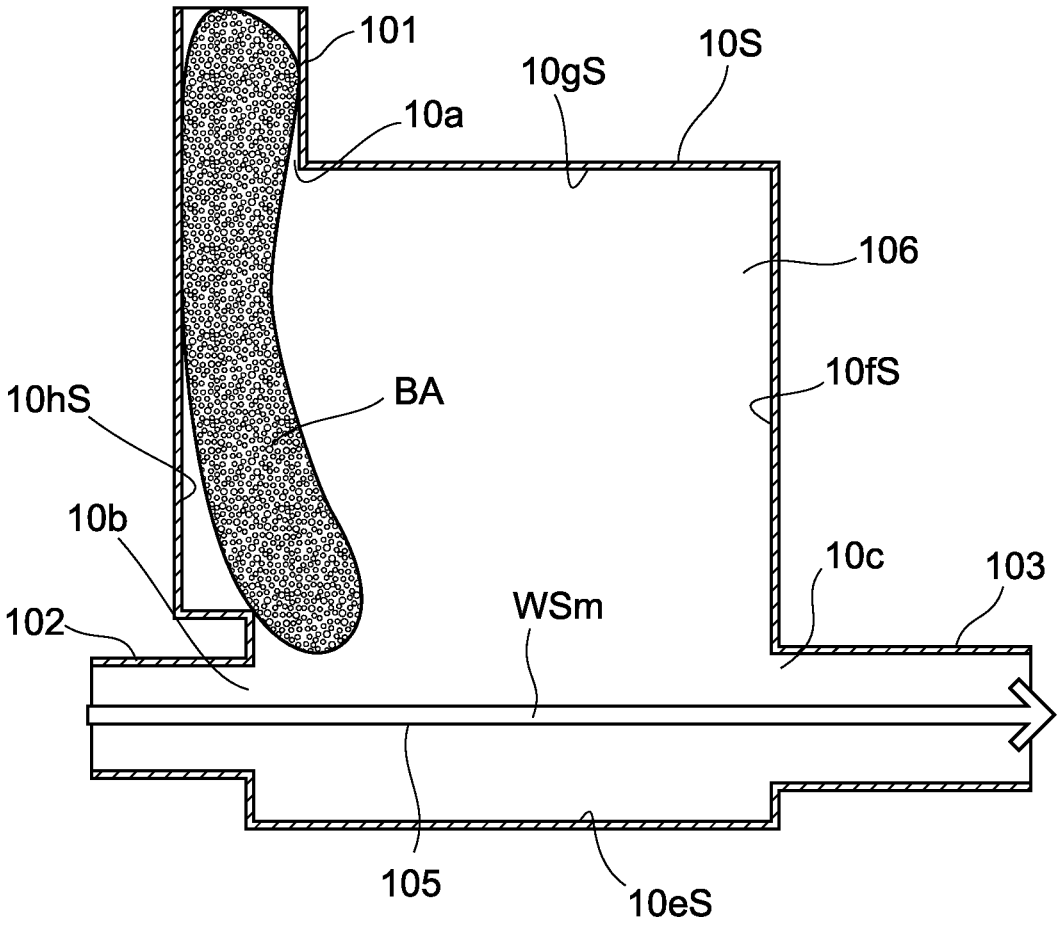
FIG. 27 is a diagram showing a modification of the water storage chamber.

Further, from the viewpoint of supplying the large air bubble BA to near the jetting port 10*b*, a form of a water storage chamber 10S shown in FIG. 27 is preferable. In the water storage chamber 10S shown in FIG. 27, a wall 10*e*S, a wall 10*f*S, a wall 10*g*S, and a wall 10*h*S for defining the chamber are provided. The wall 10*h*S is provided further on the upstream side than the jetting port 10*b*.

It is preferable from the viewpoint of surely supplying the large air bubble BA to the end on the jetting port 10*b* side of the water passing path section 105 to provide an end on the water passing path section 105 side of the wall 10*h*S, which is a guide surface for the large air bubble BA, further on the upstream side than the jetting port 10*b* in the moving direction of the jet flow WSm.

When the large air bubble BA reaches near the water passing path section 105, the large air bubble BA is drawn to near the discharge port (the water storage chamber side opening 10*c*) of the water passing path section 105 while being affected by the jet flow WSm jetted from the jetting port 10*b*. Therefore, the end of the wall 10*h*S, which is the guide surface, is provided further on the upstream side than the jetting port 10*b* to guide the large air bubble BA further to the upstream side than the jetting port 10*b* and more surely supply the large bubble BA to the end on the jetting port 10*b* side of the water passing path section 105.

Figure 28:
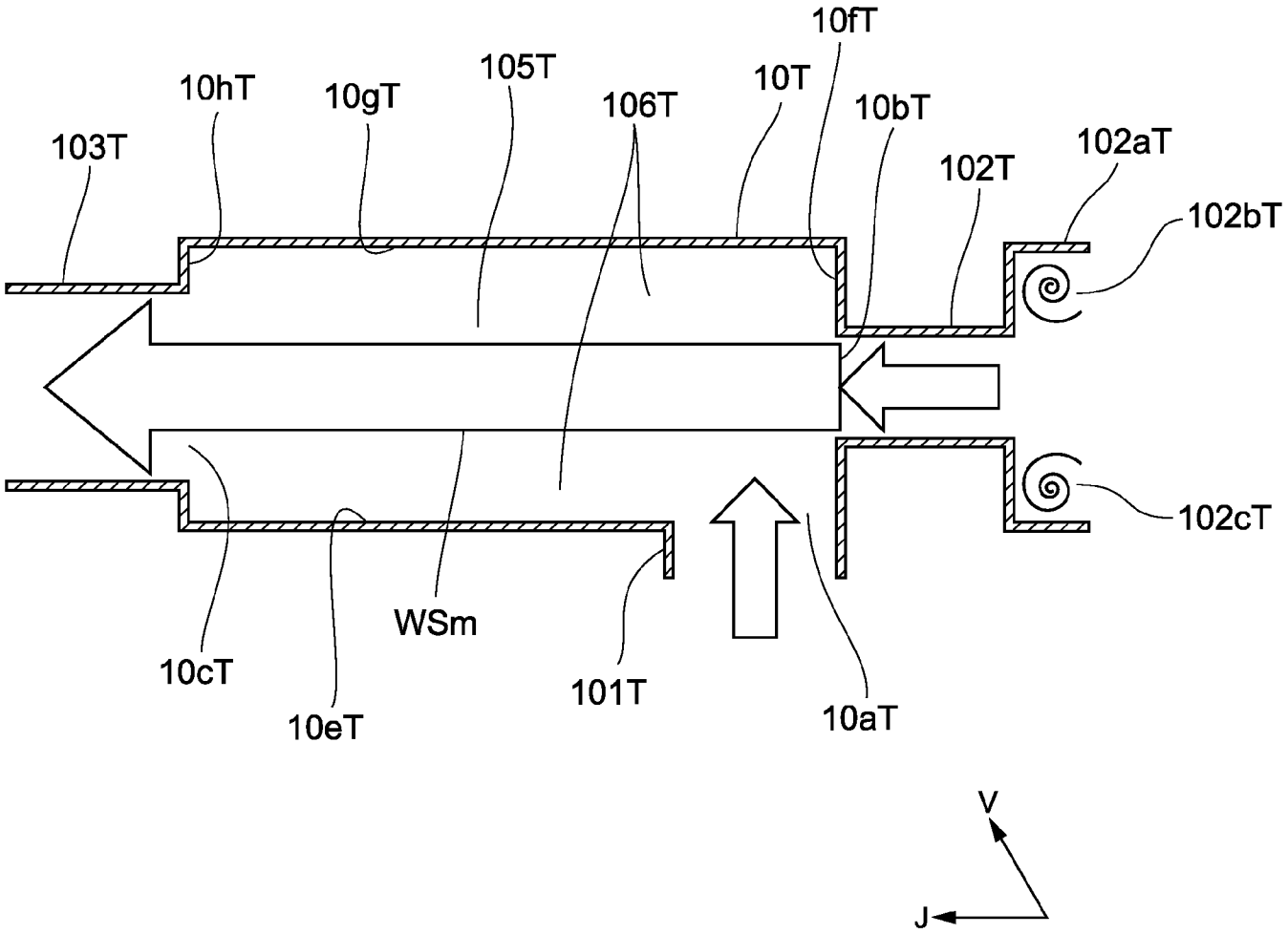
FIG. 28 is diagram showing a modification of the water storage chamber.

The embodiment of the present invention mentioned above is supplying the large air bubble, and is generating the first water passing state and the second water passing state by turns. However, it is possible to generate the first water passing state and the second water passing state by turns without supplying the large air bubble. The modification of the water storage chamber is explained below with reference to drawings FIG. 28, FIG. 29A, FIG. 29B, FIG. 29C, FIG. 29D. FIG. 28 is a diagram showing a water storage chamber 10T is the modification of the embodiment.

As shown in FIG. 28, the water storage chamber 10T includes an air conduit 101T, a water supply conduit 102T (a water supply path), and a discharge conduit 103T. The air conduit 101T, the water supply conduit 102T, and the discharge conduit 103T are conduits provided to communicate with the inside of the water storage chamber 10T.

The water storage chamber 10T is formed in a substantially rectangular parallelepiped box shape as a whole. The water storage chamber 10T includes a wall 10*e*T, a wall 10*f*T, a wall 10*g*T, a wall 10*h*T, a wall 10*i*T (not shown in figs.), and a wall 10*j*T (not shown in figs.). In FIG. 28, only the wall 10*e*T, the wall 10*f*T, the wall 10*g*T, and the wall 10*h*T are drawn to form a rectangle. The wall 10*i*T and the wall 10*j*T are walls arranged in positions opposed to each other and arranged to connect the wall 10*e*T, the wall 10*f*T, the wall 10*g*T, and the wall 10*h*T.

The air conduit 101T communicates with the inside of the water storage chamber 10T via an air lead-in port 10*a*T formed in the water storage chamber 10T. The air lead-in port 10*a*T is formed at an upstream side end of the wall 10*e*T near a corner when the wall 10*e*T and the wall 10*f*T are placed face to face.

The water supply conduit 102T communicates with the inside of the water storage chamber 10T via a jetting port 10*b*T. The jetting port 10*b*T is formed in the middle of the wall 10*f*T. A extended pass part 102*a*T is formed at an upstream side of the water supply conduit 102T.

The extended pass part 102*a*T is provided with a first negative pressure part 102*b*T and a second negative pressure part 102*c*T so that it may face across the water supply conduit 102T. The first negative pressure part 102*b*T and the second negative pressure part 102*c*T are constructed so that strength of the negative pressure which occurs in each may provide as a reverse phase. In this modification, the direction of movement of the jet stream WSm injected from the jetting port 10*b*T is periodically fluctuated using the principle of a fluid control device.

The discharge conduit 103T communicates with the inside of the water storage chamber 10T via a water storage chamber side opening 10$c$T. The water storage chamber side opening 10$c$T is formed in the middle of the wall 10$h$T.

The air conduit 101T is a conduit that connects the air lead-in port 10$a$T and an opening opened to the atmosphere. The air led in from the air conduit 101T is drawn into the inside of the water storage chamber 10T from the air lead-in port 10$a$T. The air drawn into the inside of the water storage chamber 10T.

The water supply conduit 102T is a conduit that connects the jetting port 10$b$T and a water supply source. The first water supply conduit 102T is reduced in a diameter halfway in the conduit or in the jetting port 10$b$T. Therefore, the water supplied from the first water supply conduit 102T is jetted into the water storage chamber 10T as a jet flow WSm with the speed thereof increased.

The discharge conduit 103T is a conduit that connects the water storage chamber side opening 10$c$T and the discharge port NZa formed in the nozzle NZ (see FIG. 1). In the case of this embodiment, the jetting port 10$b$T and the water storage chamber side opening 10$c$T are arranged to be opposed to each other. Therefore, the jet flow WSm jetted into the water storage chamber 10T from the jetting port 10$b$T moves along the J axis in the water storage chamber 10T and enters the discharge conduit 103T from the water storage chamber side opening 10$c$T. The water entering the discharge conduit 103T moves in the discharge conduit 103T along the J axis. The water is discharged to the outside form the discharge port NZa.

As explained above, the jet flow WSm jetted into the water storage chamber 10T from the jetting port 10$b$T moves along the J axis in the water storage chamber 10T and enters the discharge conduit 103T from the water storage chamber side opening 10$c$T. Therefore, a water passing path section 105T is formed which is a path through which the jet flow WSm passes, from the jetting port 10$b$T to the discharge port NZa. In the case of this embodiment, the water passing path section 105T is a path that connects the jetting port 10$b$T and the water storage chamber side opening 10$c$T.

The remaining region excluding the water passing path section 105T in the water storage chamber 10T is a water storing section 106T. In the case of this embodiment, the water storing section 106T is formed to surround the water passing path section 105T.

Figure 29A:
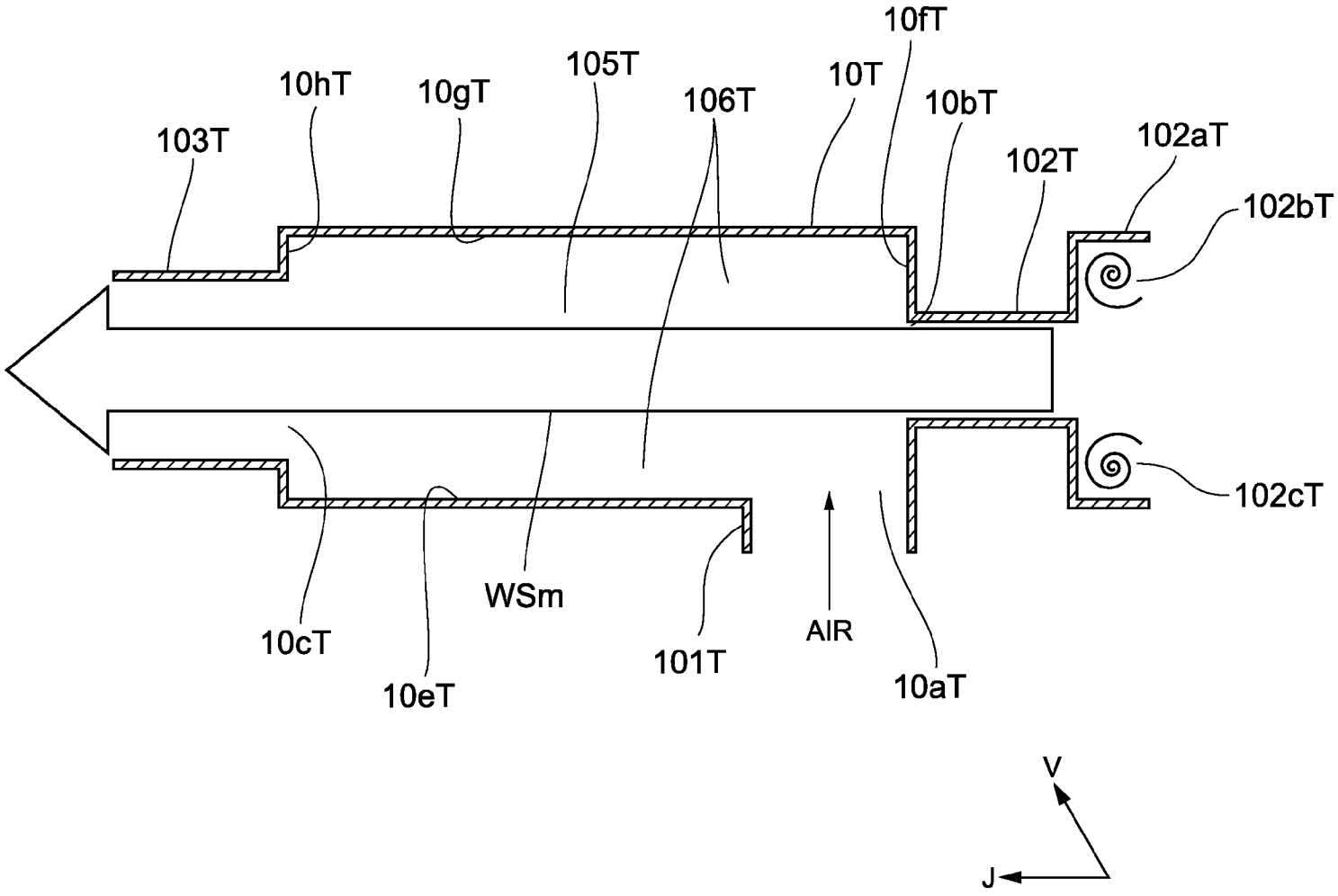
FIGS. 29A to 29D are diagrams for explaining transition of a way of flow of the jet flow in the modification shown in FIG. 28.
Figure 29B:
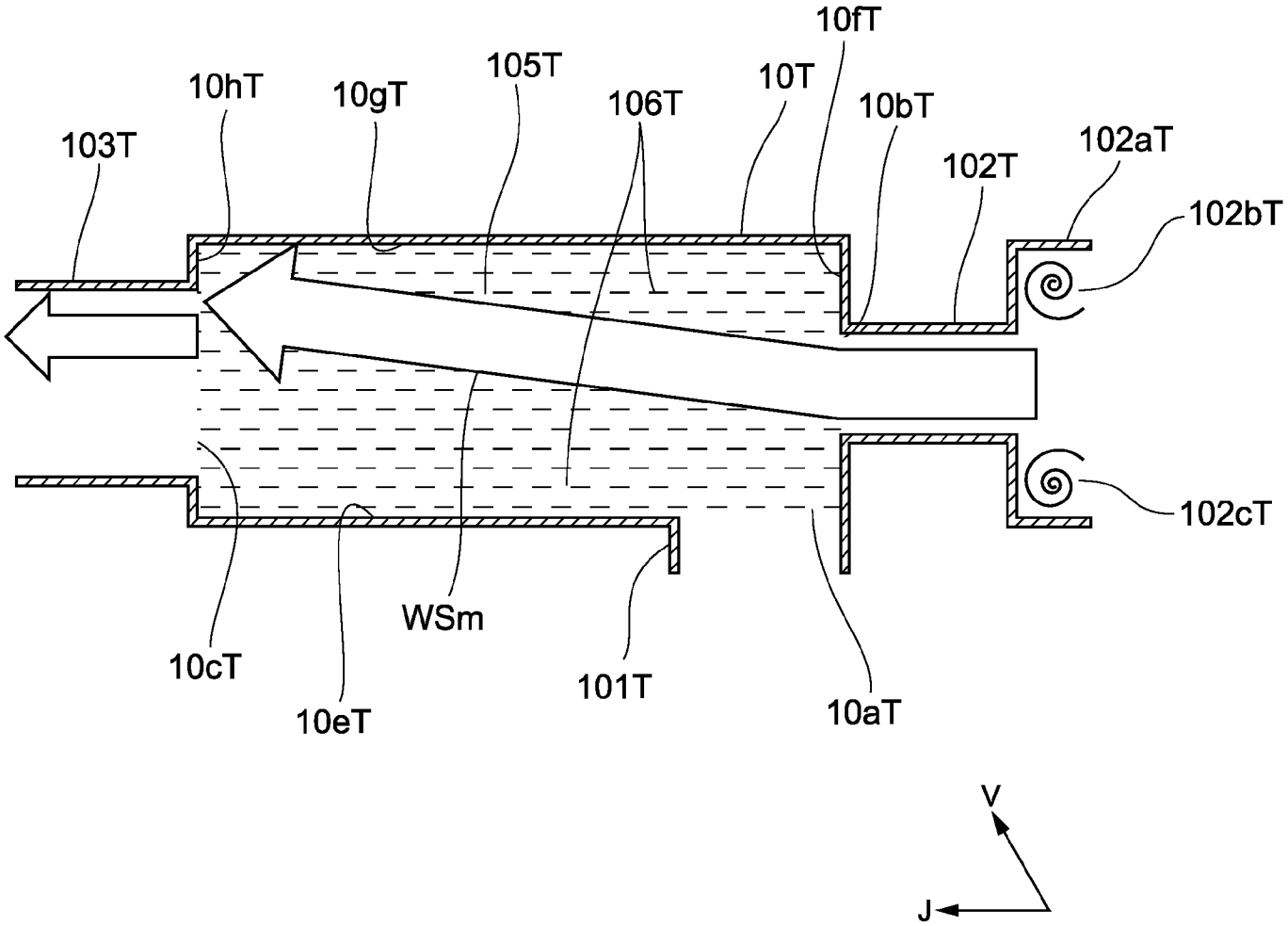
Figure 29C:
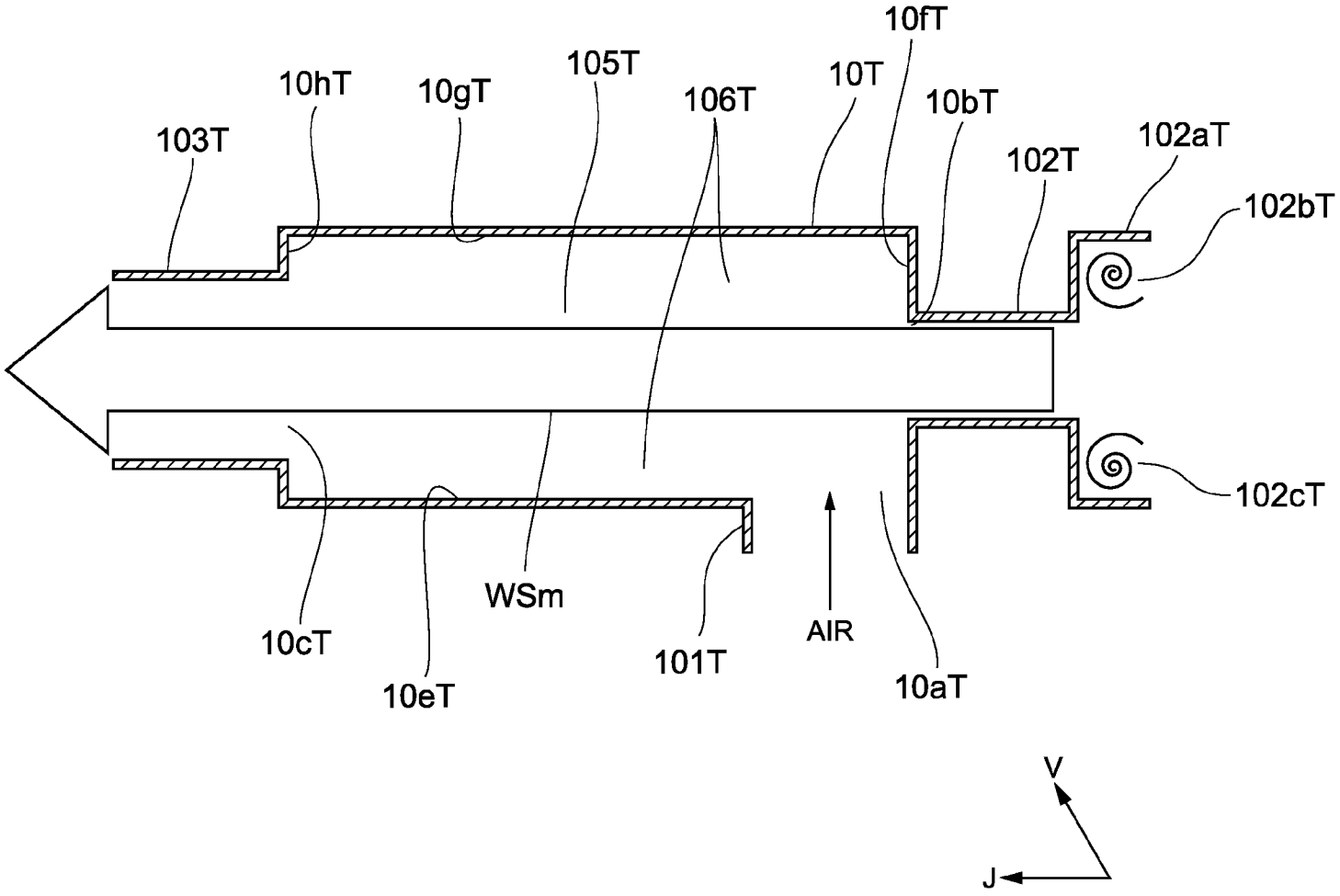
Figure 29D:
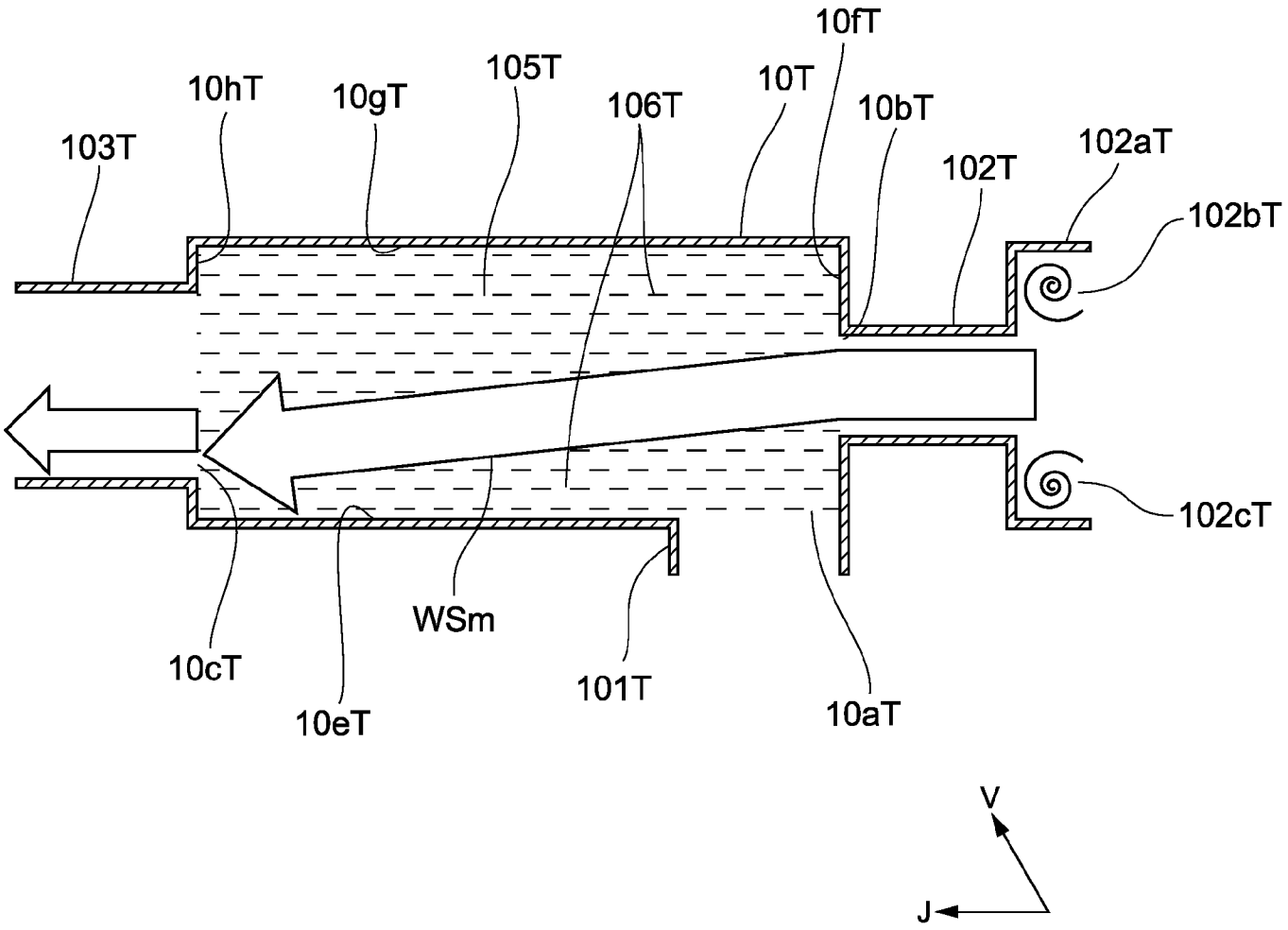

The jet stream WSm injected from the jetting port 10$b$T goes straight on, and it goes into the discharge conduit 103T from the water storage chamber side opening 10$c$T (see FIG. 29A). In this case, in the water storage chamber 10T, water does not exist in any domains other than the jet stream WSm, but the jet stream WSm advances the inside of air. If the negative pressure of the first negative pressure part 102$b$T becomes large, the jet stream WSm can be drawn near to the wall 10$g$T side, and one part of the jet stream WSm will hit the wall 10$h$T by the side of the wall 10$g$T (see FIG. 29B). The inside of the water storage chamber 10T is filled with water by this, and the jet stream WSm advances the inside of water. If the negative pressure of first negative pressure part 102$b$T becomes small and the negative pressure of second negative pressure part 102$c$T becomes large, the jet stream WSm can be drawn near to the wall 10$e$T side, and will go into the discharge conduit 103T from the water storage chamber side opening 10$c$T as it is (see FIG. 29C). In this case, in the water storage chamber 10T, water does not exist in any domains other than the jet stream WSm, but the jet stream WSm advances the inside of air. Furthermore, the jet stream WSm can draw near to the wall 10$e$T side, and the part hits the wall 10$h$T by the side of wall 10$e$T (see FIG. 29D). The inside of the water storage chamber 10T is filled with water by this, and the jet stream WSm advances the inside of water. If the negative pressure of the second negative pressure part 102$c$T becomes small and the negative pressure of the first negative pressure part 102$b$T becomes large, the jet stream WSm can be drawn near to the wall 10$g$T side, and will go into the discharge conduit 103T from the water storage chamber side opening 10$c$T as it is (see FIG. 29A). By swinging of the direction of movement of the jet stream WSm explained above, the first water passing state and the second water passing state can be generated by turns.

An air supplying section to supply air to the water passing path section 105T. According to the modification, the air supplying section (the first negative pressure part 102$b$T, the second negative pressure part 102$c$T, the jetting port 10$b$T, the water storage chamber side opening 10$c$T, the wall 10$h$T) generate a first water passing state in which the jet flow pierces through the air, by supplying the air so as to cover surroundings of the jet flow (see FIGS. 29A, 29B). The air supplying section (the first negative pressure part 102$b$T, the second negative pressure part 102$c$T, the jetting port 10$b$T, the water storage chamber side opening 10$c$T, the wall 10$h$T) generate a second water passing state in which the jet flow passes through the stored water, by depressing supply of the air (see FIGS. 29B, 29D). Since the air supplying section alternately supplies the air and depresses supply of the air, it is possible to alternately and repeatedly generate the first water passing state and the second water passing state.

What is claimed is:

1. A water discharge device that discharges water to a human body, the water discharge device comprising:

a water supply path for supplying the water;

a jetting port for jetting the water, which is supplied from the water supply path, to a downstream side as a jet flow;

a discharge channel provided on the downstream side of the jetting port and including a discharge port for discharging the jet flow to the outside;

a water storage chamber provided between the jetting port and the discharge channel and including a water passing path section, which is a path through which the jet flow passes from the jetting port to the discharge channel, and a water storing section for forming stored water to be adjacent to the water passing path section; and an air bubble supplying section configured to generate a large air bubble in the water storing section and supply the large air bubble to the water passing path section, wherein the air bubble supplying section comprises:

an air lead-in port for leading air into the water storing section, grows the air led into the water storing section from the air lead-in port into a large bubble shape as time elapses while maintaining a state in which the air lead-in port and the air bubble communicate with each other and, at a stage when the air bubble has a cross sectional area larger than a channel cross sectional area of the jetting port, intermittently supplies the air bubble to the water passing path section as the large air bubble; and further comprises a flow speed changing mechanism for changing a flow speed of a water flow formed in the water storing section so as to alternately and repeatedly generate a first water flow state and a second water flow state, the first water flow state being a state in which a sub-water flow having a relatively low flow speed, which can maintain a state in which the air lead-in port and the air bubble communicate with each other, is formed in the water storing section until the air led in from the air lead-in port is grown to the large air bubble and supplied to the water passing path section, and the second water flow state being a state in which a sub-water flow having a relatively high flow speed, which can separate the air bubble from the air lead-in port when the air led in from the air lead-in port is grown into the large air bubble and supplied to the water passing path section, is formed in the water storing section.

2. The water discharge device according to claim 1, wherein the water storing section comprises a guide surface extending from the air lead-in port side to the water passing path section side and facilitating the growth of the air bubble, and the air bubble supplying section guides the air bubble, which is formed by the air led in from the air lead-in port, to near the water passing path section while keeping a state in which the air bubble is set in contact with the guide surface.

3. The water discharge device according to claim 2, wherein the air bubble supplying section guides, with the sub-water flow in the first water flow state, the air bubble formed by the air, which is led in from the air lead-in port, to near the water passing path section while pressing the air bubble toward the guide surface.

4. The water discharge device according to claim 3, wherein the air bubble supplying section guides, with the sub-water flow in the first water flow state, the air bubble formed by the air, which is led in from the air lead-in port, to near the water passing path section while pressing the air bubble in a direction against buoyancy acting on the air bubble.

5. The water discharge device according to claim 3, wherein the guide surface comprises a first surface against which the air bubble is pressed and a second surface and a third surface arranged to be opposed to each other across the first surface.

6. The water discharge device according to claim 3, wherein the sub-water flow is led into the water storing section from a sub-water flow lead-in port formed separately and independently from the jetting port.

7. The water discharge device according to claim 6, wherein the sub-water flow presses the air bubble formed by the air led in from the air lead-in port against the guide surface in a state in which the sub-water flow does not interfere with the jet flow.

8. The water discharge device according to claim 3, wherein the size of the air lead-in port is set to a size for preventing the communication state of the air bubble formed by the air, which is led in from the air lead-in port, with the air lead-in port from being cut by the sub-water flow in the first water flow state.

9. The water discharge device according to claim 3, wherein the guide surface is formed by a continuous surface that smoothly connects a vicinity of the air lead-in port and a vicinity of the jetting port.

10. The water discharge device according to claim 3, wherein the guide surface is provided along a direction in which the air lead-in port is opened.

11. The water discharge device according to claim 3, wherein the air lead-in port is separated from the water passing path section and provided at a position near the jetting port.

* * * * *